US009636924B2

(12) United States Patent
Takahashi et al.

(10) Patent No.: US 9,636,924 B2
(45) **Date of Patent: *May 2, 2017**

(54) PRINTING APPARATUS AND PRINTING METHOD

(71) Applicant: SEIKO EPSON CORPORATION, Tokyo (JP)

(72) Inventors: Toru Takahashi, Azumino (JP); Takamitsu Kondo, Shiojiri (JP); Kazuyoshi Tanase, Matsumoto (JP); Hiroshi Wada, Azumino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/934,525

(22) Filed: Nov. 6, 2015

(65) Prior Publication Data

US 2016/0059579 A1 Mar. 3, 2016

Related U.S. Application Data

(63) Continuation of application No. 14/272,340, filed on May 7, 2014, now Pat. No. 9,205,667, which is a (Continued)

(30) Foreign Application Priority Data

Mar. 24, 2011 (JP) ..... 2011-065460

(51) Int. Cl.
*B41J 2/21* (2006.01)
*B41J 2/145* (2006.01)

(52) U.S. Cl.
CPC ..... *B41J 2/2103* (2013.01); *B41J 2/145* (2013.01); *B41J 2/21* (2013.01); *B41J 2/2132* (2013.01);
(Continued)

(58) Field of Classification Search
CPC ..... B41J 2/1433; B41J 2/162; B41J 2/1623; B41J 2/1628; B41J 2/1631
(Continued)

(56) References Cited

U.S. PATENT DOCUMENTS 8,752,927 B2 * 6/2014 Takahashi ..... B41J 2/2132 347/12
9,205,667 B2 * 12/2015 Takahashi ..... B41J 2/21 347/47
(Continued)

FOREIGN PATENT DOCUMENTS

CN 1836908 A 9/2006
JP 06-255175 A 9/1994
(Continued)

*Primary Examiner* — Alessandro Amari
*Assistant Examiner* — Roger W Pisha, II
(74) *Attorney, Agent, or Firm* — Maschoff Brennan

(57) ABSTRACT

A printing apparatus is provided in which a position of a joint of a first yellow nozzle group and a second yellow nozzle group in a predetermined direction is offset from a position of a joint of a first magenta nozzle group and a second magenta nozzle group in a predetermined position and a position of a joint of a first cyan nozzle group and a second cyan nozzle group in the predetermined position, and the position of the joint of the first magenta nozzle group and the second magenta nozzle group in the predetermined position is the same as the position of the joint of the first cyan nozzle group and the second cyan nozzle group in the predetermined direction.

11 Claims, 10 Drawing Sheets

Related U.S. Application Data continuation of application No. 13/429,302, filed on Mar. 23, 2012, now Pat. No. 8,752,927.

(52) U.S. Cl.
CPC ..... *B41J 2/2135* (2013.01); *B41J 2202/19* (2013.01); *B41J 2202/20* (2013.01)

(58) Field of Classification Search
USPC ..... 347/47
See application file for complete search history.

(56) References Cited

U.S. PATENT DOCUMENTS

| | | | | |
|---|---|---|---|---|
| 2004/0114017 | A1* | 6/2004 | Yokoyama | B41J 11/002 347/102 |
| 2004/0119780 | A1 | 6/2004 | Usui et al. | |
| 2005/0128248 | A1 | 6/2005 | Wada et al. | |
| 2006/0214957 | A1 | 9/2006 | Wada | |
| 2006/0227195 | A1* | 10/2006 | Arai | B41J 13/14 347/104 |
| 2006/0290740 | A1* | 12/2006 | Akahane | B41J 2/155 347/40 |
| 2007/0076052 | A1 | 4/2007 | Otokita | |
| 2008/0055379 | A1 | 3/2008 | Ishikawa et al. | |
| 2009/0085959 | A1 | 4/2009 | Yoshida et al. | |
| 2009/0115805 | A1 | 5/2009 | Yoshida et al. | |
| 2009/0244155 | A1 | 10/2009 | Yuda et al. | |
| 2009/0278882 | A1 | 11/2009 | Yoshida et al. | |
| 2010/0053246 | A1* | 3/2010 | Kasahara | B41J 2/155 347/12 |
| 2010/0053247 | A1 | 3/2010 | Kakutani | |
| 2010/0201771 | A1 | 8/2010 | Mitsuzawa | |
| 2010/0245441 | A1 | 9/2010 | Tokunaga et al. | |
| 2010/0245871 | A1 | 9/2010 | Tokunaga et al. | |
| 2011/0018917 | A1 | 1/2011 | Fujisawa et al. | |

FOREIGN PATENT DOCUMENTS

| | | | |
|---|---|---|---|
| JP | 2005-199692 | A | 7/2005 |
| JP | 2008-162176 | A | 7/2008 |
| JP | 2009-274232 | A | 11/2009 |
| JP | 2011-037069 | A | 2/2011 |

* cited by examiner

PRINTING APPARATUS AND PRINTING METHOD

CROSS-REFERENCE TO RELATED APPLICATIONS

This application is a continuation of U.S. patent application Ser. No. 14/272,340, filed May 7, 2014, which is a continuation of U.S. patent application Ser. No. 13/429,302, filed Mar. 23, 2012, now issued as U.S. Pat. No. 8,752,927, which claims priority to Japanese Patent Application No. 2011-065460, filed on Mar. 24, 2011. The foregoing patent applications are incorporated herein by reference.

BACKGROUND

1. Technical Field

The present invention relates to a printing apparatus and a printing method.

2. Related Art

As a printing apparatus, there is an ink jet printer (hereinafter, referred to as a printer) having a head ejecting ink from nozzles. As such a printer, there is a printer in which a plurality of heads are connected and disposed to increase a printable image width.

However, the nozzle distance in nozzle rows formed in the head is very small. For this reason, when the plurality of heads are connected and disposed and their position relative to each other deviates, the ink concentration at an image part printed at a joint of the heads becomes thicker or thinner. A printer in which end portions of heads (end portions of nozzle rows) are overlapped is proposed. An example of the related art is disclosed in JP-A-6-255175.

It is possible to make concentration unevenness of the image part printed at the joint of the heads invisible by overlapping the end portions of the heads (end portions of nozzle rows), but it is difficult to completely remove the concentration unevenness. For this reason, in the printer ejecting ink with a plurality of colors, when the positions of the joint of the heads of all the colors are the same, the image part printed at the joint are overlapped and printed, and the concentration unevenness may be exacerbated. Accordingly, the image part printed at the joint is visible on the printed image, and image quality of the printed image deteriorates.

SUMMARY

An advantage of some aspects of the invention is to suppress deterioration of image quality of a printed image.

According to an aspect of the invention, there is provided a printing apparatus including: a first yellow nozzle group in which a plurality of nozzles ejecting a yellow ink are arranged in a predetermined direction; a second yellow nozzle group in which a plurality of nozzles ejecting a yellow ink are arranged in the predetermined direction and which is disposed to be offset from the first yellow nozzle group in the predetermined direction; a first magenta nozzle group in which a plurality of nozzles ejecting a magenta ink are arranged in the predetermined direction; a second magenta nozzle group in which a plurality of nozzles ejecting a magenta ink are arranged in the predetermined direction and which is disposed to be offset from the first magenta nozzle group in the predetermined direction; a first cyan nozzle group in which a plurality of nozzles ejecting a cyan ink are arranged in the predetermined direction; a second cyan nozzle group in which a plurality of nozzles ejecting a cyan ink are arranged in the predetermined direction and which is disposed to be offset from the first cyan nozzle group in the predetermined direction; and a control unit that controls to eject ink from the nozzles while relatively moving the nozzle groups and a medium in a direction crossing the predetermined direction, and to print an image on the medium, wherein a position of a joint of the first yellow nozzle group and the second yellow nozzle group in the predetermined direction is offset from a position of a joint of the first magenta nozzle group and the second magenta nozzle group in the predetermined position and a position of a joint of the first cyan nozzle group and the second cyan nozzle group in the predetermined position, and wherein the position of the joint of the first magenta nozzle group and the second magenta nozzle group in the predetermined position is the same as the position of the joint of the first cyan nozzle group and the second cyan nozzle group in the predetermined direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Summary of Disclosure

Figure 1A:
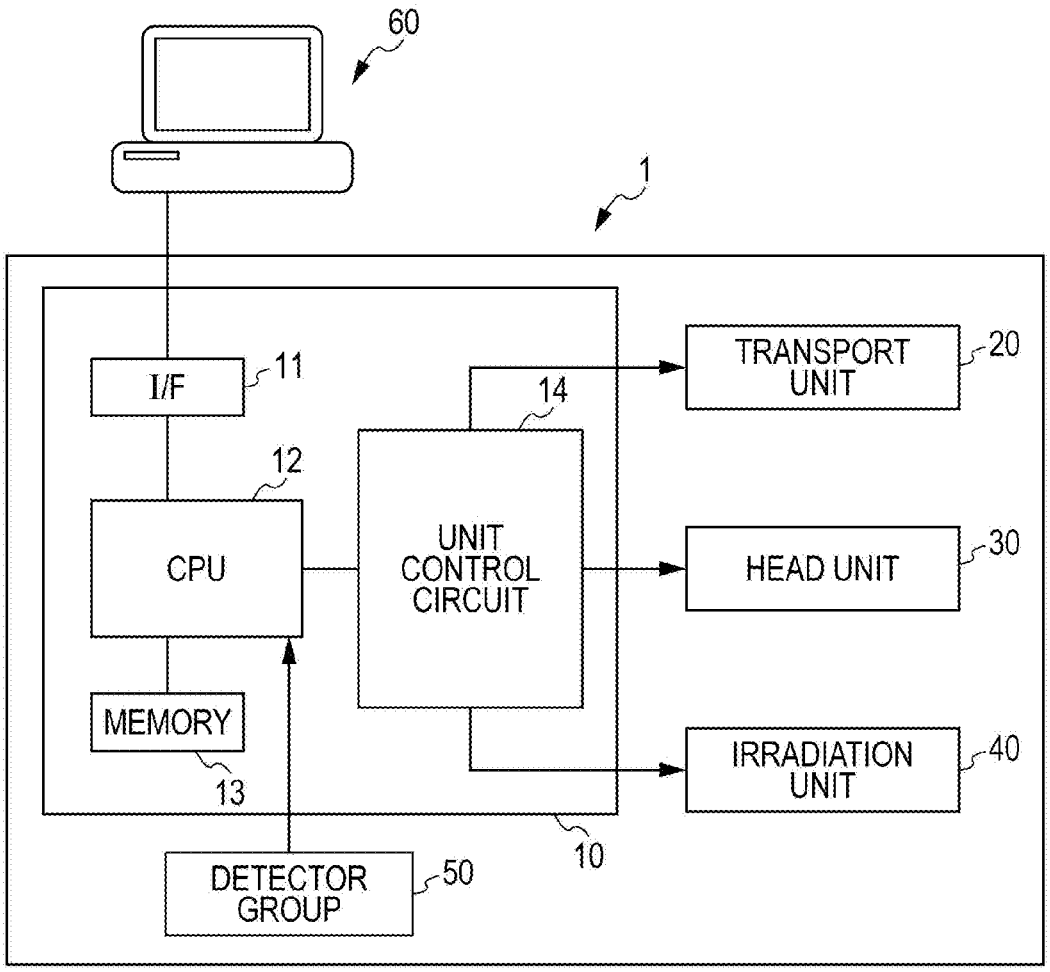
FIG. 1A is a block diagram illustrating an overall configuration of a printer.

At least the following will be clarified by description of the specification and description of the accompanying drawings.

That is, there is provided a printing apparatus including: a first yellow nozzle group in which a plurality of nozzles ejecting a yellow ink are arranged in a predetermined direction; a second yellow nozzle group in which a plurality of nozzles ejecting a yellow ink are arranged in the predetermined direction and which is disposed to be offset from the first yellow nozzle group in the predetermined direction; a first magenta nozzle group in which a plurality of nozzles ejecting a magenta ink are arranged in the predetermined direction; a second magenta nozzle group in which a plurality of nozzles ejecting a magenta ink are arranged in the predetermined direction and which is disposed to be offset from the first magenta nozzle group in the predetermined direction; a first cyan nozzle group in which a plurality of nozzles ejecting a cyan ink are arranged in the predetermined direction; a second cyan nozzle group in which a plurality of nozzles ejecting a cyan ink are arranged in a predetermined direction and which is disposed to be offset from the first cyan nozzle group in the predetermined direction; and a control unit that controls to eject ink from the nozzles while relatively moving the nozzle groups and a medium in a direction crossing the predetermined direction, to print an image on the medium, wherein a position of a joint of the first yellow nozzle group and the second yellow nozzle group in the predetermined direction is offset from a position of a joint of the first magenta nozzle group and the second magenta nozzle group in the predetermined position and a position of a joint of the first cyan nozzle group and the second cyan nozzle group in the predetermined position, and wherein the position of the joint of the first magenta nozzle group and the second magenta nozzle group in the predetermined position is the same as the position of the joint of the first cyan nozzle group and the second cyan nozzle group in the predetermined direction.

According to such a printing apparatus, it is possible to make an image part printed at the joint of the nozzle groups invisible, and it is possible to suppress deterioration of image quality of the printed image. In addition, it is possible to make a printable width in a predetermined direction as long as possible.

The printing apparatus further includes: a first black nozzle group in which a plurality of nozzles ejecting a black ink are arranged in the predetermined direction; and a second black nozzle group in which a plurality of nozzles ejecting a black ink are arranged in the predetermined direction and which is disposed to be offset from the first black nozzle group in the predetermined direction, wherein a position of a joint of the first black nozzle group and the second black nozzle group in the predetermined direction is the same as a position of a joint of the first magenta nozzle group and the second magenta nozzle group in the predetermined position and a position of a joint of the first cyan nozzle group and the second cyan nozzle group in the predetermined position.

According to such a printing apparatus, it is possible to make an image part printed at the joint of the nozzle groups invisible, and it is possible to suppress deterioration of image quality of the printed image. In addition, it is possible to make a printable width in a predetermined direction as long as possible.

In the printing apparatus, the ink ejected from the nozzles is a light-curing ink that is cured by irradiation of light.

According to such a printing apparatus, it is possible to make an image part printed at the joint of the nozzle groups invisible, and it is possible to suppress deterioration of image quality of the printed image. In addition, it is possible to make a printable width in a predetermined direction as long as possible.

The printing apparatus further includes a storage unit that stores a correction value calculated for each column area that is an area on the medium forming a dot column along the intersection direction by a test pattern printed on the basis of an instruction gradation value representing a predetermined concentration, for each color of ink, wherein an image is printed on the medium on the basis of a gradation value obtained by correcting a gradation value representing a concentration of a printed image with the correction value.

According to such a printing apparatus, it is possible to make an image part printed at the joint of the nozzle groups invisible, and it is possible to suppress deterioration of image quality of the printed image.

In addition, there is provided a printing method of a printing apparatus including a first yellow nozzle group in which a plurality of nozzles ejecting a yellow ink are arranged in a predetermined direction, a second yellow nozzle group in which a plurality of nozzles ejecting a yellow ink are arranged in the predetermined direction and which is disposed to be offset from the first yellow nozzle group in the predetermined direction, a first magenta nozzle group in which a plurality of nozzles ejecting a magenta ink are arranged in the predetermined direction, a second magenta nozzle group in which a plurality of nozzles ejecting a magenta ink are arranged in the predetermined direction and which is disposed to be offset from the first magenta nozzle group in the predetermined direction, a first cyan nozzle group in which a plurality of nozzles ejecting a cyan ink are arranged in the predetermined direction, and a second cyan nozzle group in which a plurality of nozzles ejecting a cyan ink are arranged in the predetermined direction and which is disposed to be offset from the first cyan nozzle group in the predetermined direction, wherein a position of a joint of the first yellow nozzle group and the second yellow nozzle group in the predetermined direction is offset from a position of a joint of the first magenta nozzle group and the second magenta nozzle group in the predetermined position and a position of a joint of the first cyan nozzle group and the second cyan nozzle group in the predetermined position, wherein the position of the joint of the first magenta nozzle group and the second magenta nozzle group in the predetermined position is the same as the position of the joint of the first cyan nozzle group and the second cyan nozzle group in the predetermined direction, and wherein ink is ejected from the nozzles while relatively moving the nozzle groups and a medium in a direction crossing the predetermined direction, to print an image on the medium.

According to such a printing apparatus, it is possible to make an image part printed at the joint of the nozzle groups invisible, and it is possible to suppress deterioration of image quality of the printed image. In addition, it is possible to make a printable width in a predetermined direction as long as possible.

Printing System

A printing apparatus is an ink jet printer (hereinafter, referred to as a printer), and a printing system according to an embodiment in which the printer and a computer are connected to each other will be described by way of example.

Figure 1B:
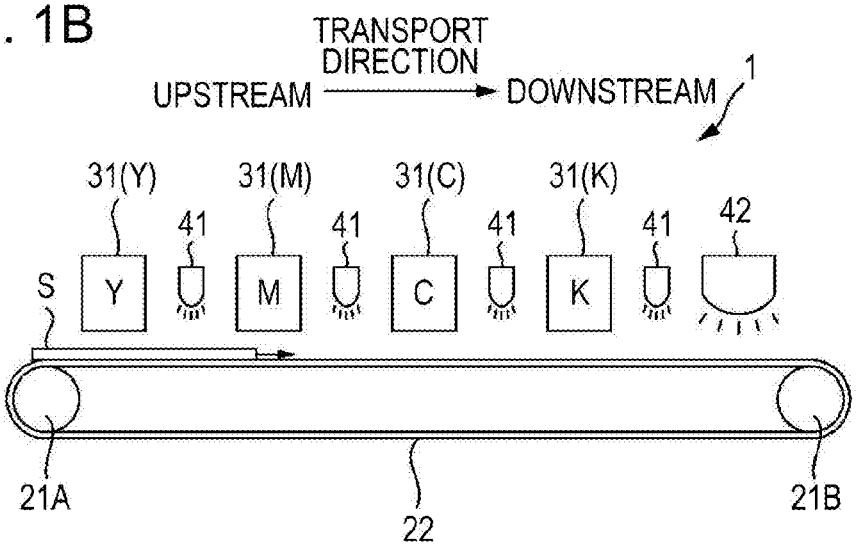
FIG. 1B is a schematic cross-sectional view of the printer.

FIG. 1A is a block diagram of an overall configuration of the printer 1 and FIG. 1B is a schematic cross-sectional view of the printer 1. The printer 1 of the embodiment ejects ultraviolet curing ink (corresponding to light curing ink) cured by irradiation of an ultraviolet ray to print an image on a medium S (for example, paper, cloth, or film). The ultraviolet curing ink (hereinafter, referred to as UV ink) is ink including ultraviolet curing resin, and is cured by photo polymerization reaction on the ultraviolet curing resin when the ink is subjected by irradiation of the ultraviolet ray.

A computer 60 is connected to communicate with the printer 1, and outputs printing data for causing the printer 1 to print an image, to the printer 1.

A controller 10 is a control unit that controls the printer 1. An interface unit 11 is provided for transmission and reception of data between the computer 60 and the printer 1. A CPU 12 is an operation processing device that controls the whole of the printer 1. A memory secures an area in which programs of the CPU 12 are stored, a work area, or the like. The CPU 12 controls units according to a unit control circuit 14. A detector group 50 monitors the situation in the printer 1, and the controller 10 controls the units on the basis of the detection result.

As shown in FIG. 1B, a transport unit 20 has transport rollers 21A and 21B and a transport belt 22, and transports the medium S from the upstream side to the downstream side in the transport direction. The medium S is transported at a constant speed without stopping on the transport belt 22 while being opposed to the head group 31 or ultraviolet irradiation units 41 and 42. The medium S on the transport belt 22 is subjected to suction adsorption or electrostatic adsorption, and positional variation of the medium S is prevented.

A head unit 30 is provided to eject the UV ink to the medium S, and has four head groups 31 ejecting UV inks (YMCK) of four colors. In order from the upstream side in the transport direction, a yellow head group 31(Y) ejecting the yellow ink, a magenta head group 31(M) ejecting the magenta ink, a cyan ink head group 31(C) ejecting the cyan ink, and a black head group 31(K) ejecting the black ink are arranged.

Figure 2:
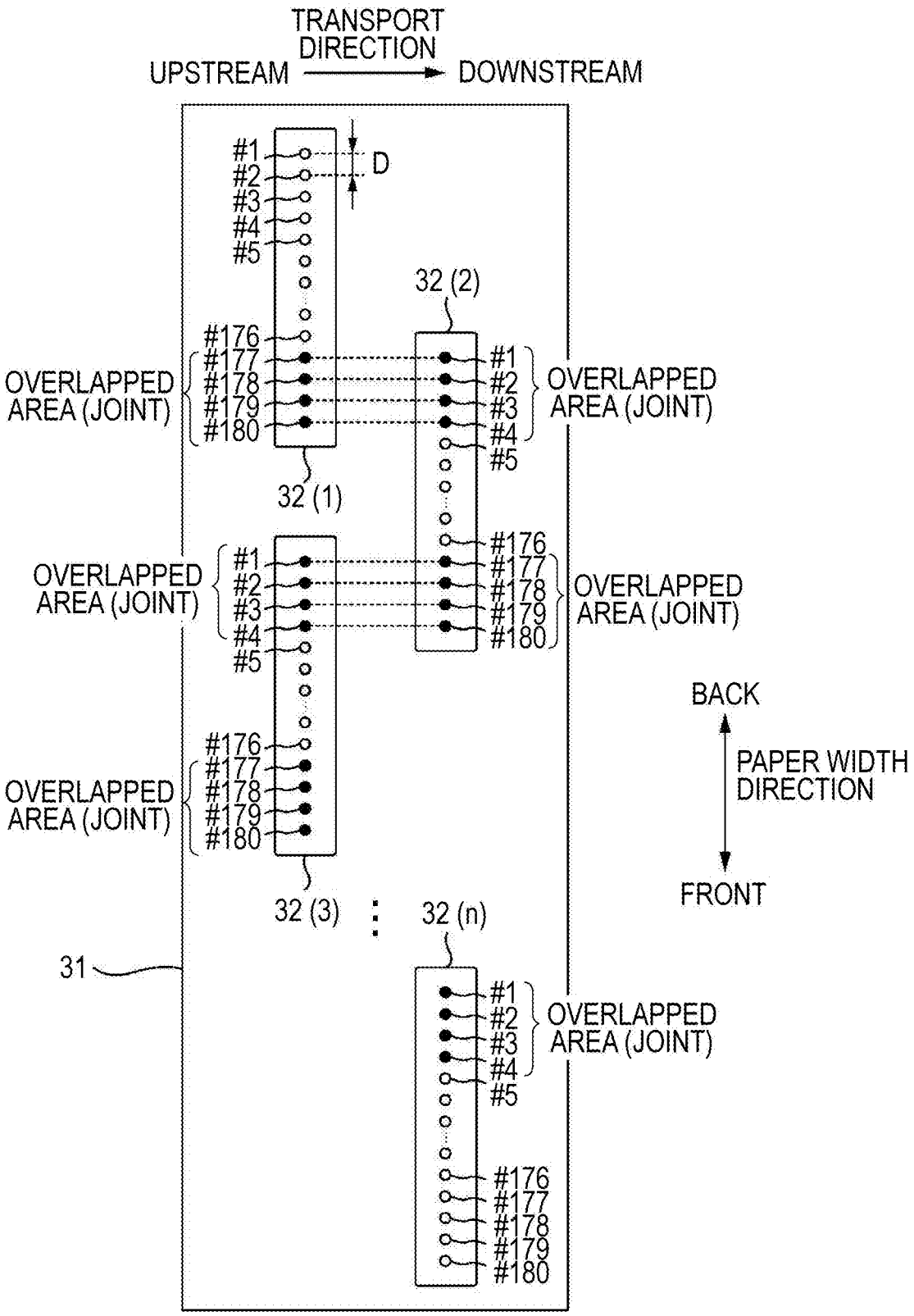
FIG. 2 is a diagram illustrating a bottom face of a head group of a color.

FIG. 2 is a diagram illustrating a bottom face of the head group 31 of a color. FIG. 2 is a diagram virtually viewing the arrangement of the nozzles from the upper side of the head group 31. In each head group 31, a plurality of thin rectangular heads 32(1) to 32(*n*) are arranged in a paper width direction (corresponding to the predetermined direction) crossing the transport direction. On the bottom face of each thin rectangular head 32 (face opposed to the medium S), a nozzle column in which 180 nozzles ejecting the ink are arranged at a predetermined distance D in the paper width direction is formed. For description, "first thin rectangular head 32(1), second thin rectangular head 32(2), . . . " are called in order from the thin rectangular heads 32 on the back side in the paper width direction, and a small number among the nozzles belonging to the nozzle column is attached in order from the nozzles on the back side in the paper width direction (#1 to #180).

In each head group 31, a plurality of thin rectangular heads 32(1) to 32(*n*) are disposed to overlap with an end portion (end portion of nozzle column) in the paper width direction of the thin rectangular head 32. Specifically, between two thin rectangular heads (for example, 32(1) and 32(2)) arranged in the paper width direction, a position in the paper width direction of four end portion nozzles (for example, #177 to #180) on the front side in the paper width direction of the thin rectangular head (for example, 32(1)) on the back side in the paper width direction is the same as a position in the paper width direction of four end portion nozzles (for example, #1 to #4) on the back side in the paper width direction of the thin rectangular head (for example, 32(2)) on the front side in the paper width direction.

Therefore, on the bottom face of the head group 31, a plurality of nozzles are arranged at a predetermined distance D in the paper width direction. Accordingly, when the controller 10 (corresponding to control unit) moves the medium S with respect to the head group 31 in the transport direction (corresponding to direction crossing predetermined direction), the controller 10 controls to discontinuously eject the ink from the nozzles, a plurality of dot columns taken along the transport direction are arranged and printed in the paper width direction, and a 2-dimensional image is printed on the medium S. The method of ejecting the ink from the nozzles may be a piezoelectric method of applying voltage to a driving element to expand and contract a pressure chamber filled with the ink to eject the ink, and may be a thermal method of generating air bubbles in the nozzles using a heat generating element to eject the ink by the air bubbles.

For the following description, an area where the end portion nozzles (#1 to #4 and #177 to #180, black painted nozzles) of the thin rectangular heads 32 arranged in the paper width direction are overlapped is referred to as "overlapped area". The overlapped area corresponds to a joint (joint of nozzle columns) of the thin rectangular heads 32 arranged in the paper width direction.

An irradiation unit 40 irradiates the UV ink landing on the medium S with the ultraviolet ray to cure the UV ink, and has four preliminary irradiation units 41 and a main irradiation unit 42. The preliminary irradiation units 41 irradiate with the ultraviolet ray to the extent that the UV ink is not completely cured, and the main irradiation unit 42 lastly irradiates with the ultraviolet ray to completely cure the UV ink. That is, the UV ink is cured in two stages.

As shown in FIG. 1B, the preliminary irradiation unit 41 is provided between the head groups 31 ejecting the inks with different colors. For this reason, the UV ink ejected from any head group 31 is cured (semi-cured) by the preliminary irradiation unit 41 before the UV ink is ejected from the head group 31 on the downstream side in the transport direction from the head group 31. As a result, it is possible to prevent blur between the UV inks with different colors.

A light source of irradiation of the ultraviolet ray may be, for example, a light emitting diode (LED), a metal halide lamp, and a mercury lamp. The length of the preliminary irradiation unit 41 and the main irradiation unit 42 in the paper width direction is substantially the same as the length of the head group 31 in the paper width direction, the UV ink on the medium S ejected from the head groups 31 is irradiated with the ultraviolet ray over the whole area in the paper width direction.

Concentration Error of Joint of Image

Figure 3A:
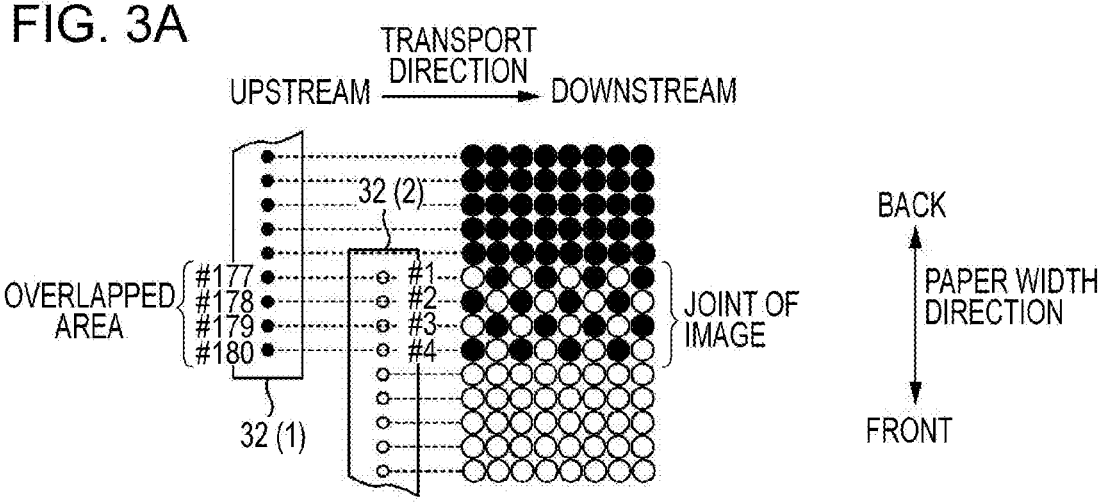
FIG. 3A is a diagram illustrating thin rectangular heads disposed in accordance with the design.

FIG. 3A is a diagram illustrating shapes of dots formed when the thin rectangular head 32 is disposed as designed. In the drawings, dots formed by the first thin rectangular head 32(1) are represented by black circles (●), and dots formed by the second thin rectangular head 32(2) are represented by white circle (○). In the embodiment, on design, the thin rectangular heads 32 are disposed such that the positions in the paper width direction of the end portion nozzles of the thin rectangular head 32 in the paper width direction, that is, the nozzles (#177 to #180 and #1 to #4) belonging to the overlapped area are the same. For example, the position in the paper width direction of the nozzle #177 of the first thin rectangular head 32(1) is the same as the position in the paper width direction of the nozzle #1 of the second thin rectangular head 32(2).

In the nozzles belonging to the overlapped area, the positions in the paper width direction are the same. In the two nozzles belonging to the other shot head 32, one dot column (hereinafter, referred to as raster line) taken along the transport direction is formed. For example, the nozzle #177 of the first thin rectangular head 32(1) and the nozzle #1 of the second thin rectangular head 32(2) alternately form dots in the transport direction to form one raster line. In such a manner, it is possible to make the joint of the image formed by the first thin rectangular head 32(1) and the image formed by the second thin rectangular head 32(2) invisible.

Figure 3B:
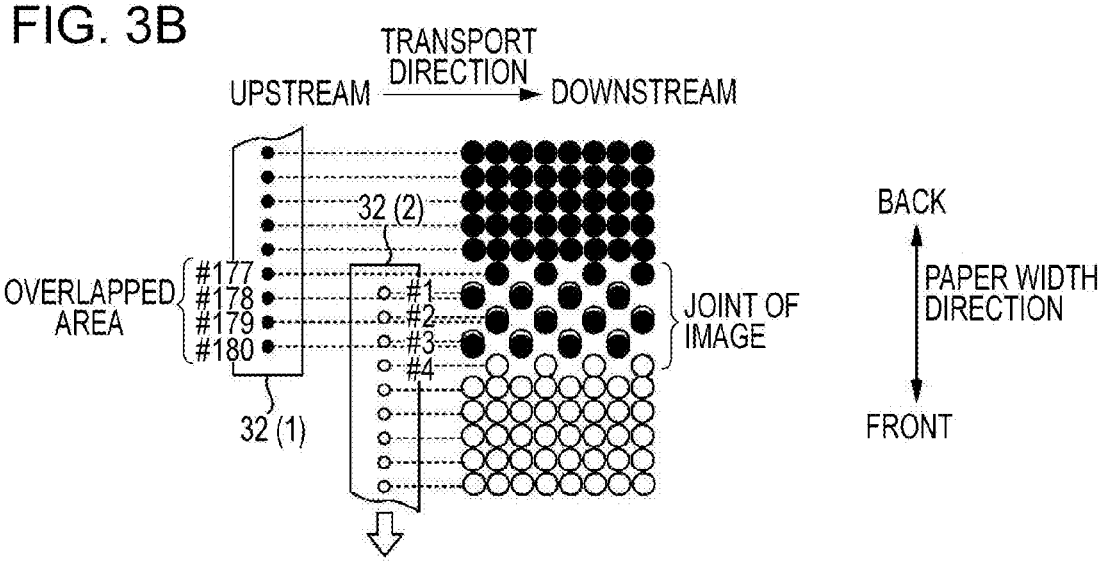
FIG. 3B is a diagram illustrating that the thin rectangular heads are disposed apart.

FIG. 3B is a diagram illustrating shapes of dots formed when the second thin rectangular head 32(2) is separately disposed with respect to the first thin rectangular head 32(1). As shown in FIG. 3A, when the first thin rectangular head 32(1) and the second thin rectangular head 32(2) are disposed as designed, the position in the paper width direction of the dots formed by the nozzles (#177 to #180) of the overlapped area of the first thin rectangular head 32(1) is the same as the position in the paper width direction of the dots formed by the nozzles (#1 to #4) of the overlapped area of the second thin rectangular head 32(2).

However, the nozzle distance in the nozzle column is very small, and thus, as shown in FIG. 3B, the second thin rectangular head 32(2) may be disposed to be offset on the front side in the paper width direction to be separated from the first thin rectangular head 32(1). In this case, the dots formed by the nozzles of the overlapped area of the second thin rectangular head 32(2) are offset on the front side in the paper width direction from the dots formed by the nozzles of the overlapped area of the first thin rectangular head 32(1). Accordingly, dot density of the medium part at which the dots have to be formed by the nozzles of the overlapped area becomes low (the amount of ejected ink becomes small), and thus the concentration of the joint of the image formed by the first thin rectangular head 32(1) and the image formed by the second thin rectangular head 32(2) becomes low.

That is, the joint part of the images printed by the first thin rectangular head 32(1) and the second thin rectangular head 32(2) (that is, image part printed at the joint of the thin rectangular heads 32) is recognized as a white streak taken along the transport direction on the printed image, and the image quality of the printed image deteriorates.

Figure 3C:
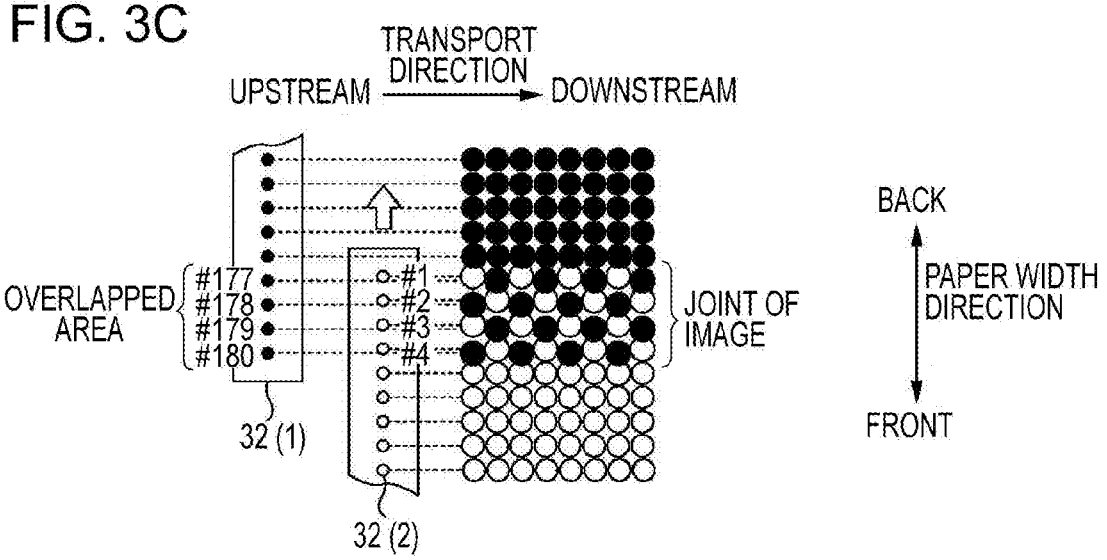
FIG. 3C is a diagram illustrating the thin rectangular heads are closely disposed.

FIG. 3C is a diagram illustrating shapes of dots formed when the second thin rectangular head 32(2) is disposed close to the first thin rectangular head 32(1). Contrary to FIG. 3B, the second thin rectangular head 32(2) may be disposed on the back side in the paper width direction to be close to the first thin rectangular head 32(1).

That is, the dots formed by the nozzles of the overlapped area of the second thin rectangular head 32(2) may deviate on the back side in the paper width direction from the dots formed by the nozzles of the overlapped area of the first thin rectangular head 32(1). Accordingly, dot density of the medium part at which the dots have to be formed by the nozzles of the overlapped area becomes high (the amount of ejected ink becomes large), and thus the concentration of the joint of the image formed by the first thin rectangular head 32(1) and the image formed by the second thin rectangular head 32(2) becomes high.

That is, the joint part of the images printed by the first thin rectangular head 32(1) and the second thin rectangular head 32(2) (that is, image part printed at the joint of the thin rectangular heads 32) is recognized as a black streak taken along the transport direction on the printed image, and the image quality of the printed image deteriorates.

As described above, when the relative position relationship of the thin rectangular heads 32 arranged in the paper width direction deviates from the relative position relationship on design, a concentration error occurs at the image part (joint of image) printed at the joint (overlapped area) of the thin rectangular heads 32. Accordingly, concentration unevenness (streak taken along the transport direction) occurs on the printed image, and the image quality of the printed image deteriorates.

Figure 4:
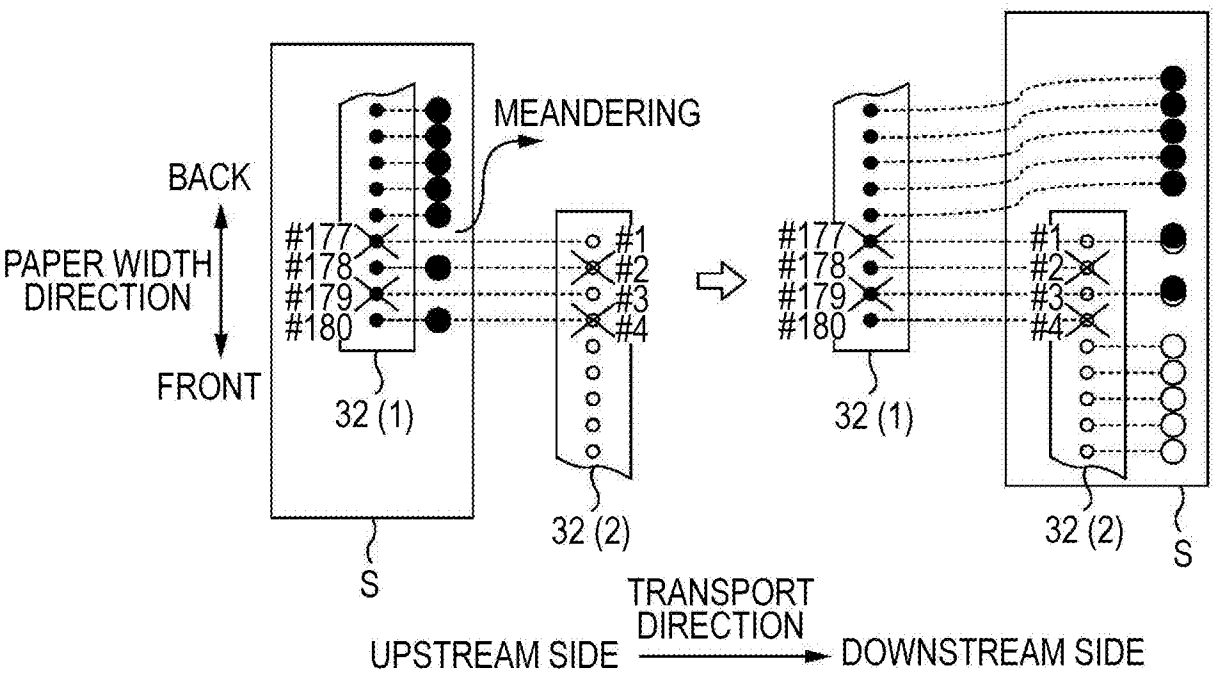
FIG. 4 is a diagram illustrating that a medium is transported askew.

FIG. 4 is a diagram illustrating dots formed when the medium S is transported askew. In FIG. 4, the relative position relationship of the thin rectangular heads 32 arranged in the paper width direction is as designed, and the position in the paper width direction of the nozzles (#177 to #180) of the overlapped area of the first thin rectangular head 32(1) is the same as the position in the paper width direction of the nozzles (#1 to #4) of the overlapped area of the second thin rectangular head 32(2).

By the way, the thin rectangular heads 32 arranged in the paper width direction are disposed to be offset in the transport direction such that the end portions thereof are overlapped. For example, the first thin rectangular head 32(1) is positioned to be offset on the upstream side in the transport direction from the second thin rectangular head 32(2). Accordingly, as shown on the left of FIG. 4, first, the first thin rectangular head 32(1) forms dots (●) on the medium S. In addition, the nozzles #178 and #180 of the nozzles of the overlapped area of the first thin rectangular head 32(1) form dots, and the nozzles #1 and #3 of the nozzles of the overlapped area of the second thin rectangular head 32(2) form dots.

After the first thin rectangular head 32(1) forms the dots, the medium S is transported while skewing on the back side in the paper width direction. As shown on the right of FIG. 4, the second thin rectangular head 32(2) forms dots (○) at the position on the front side in the paper width direction from the position on the medium S at which the second thin rectangular head 32(2) has to originally form the dots. That is, the dots are formed as the second thin rectangular head 32(2) is disposed to be offset on the front side in the paper width direction to be separated from the first thin rectangular head 32(1) (FIG. 3B), and the concentration of the joint of the image formed by the first thin rectangular head 32(1) and the image formed by the second thin rectangular head 32(2) becomes low.

On the contrary, when the medium S is transported while skewing on the front side in the paper width direction between the first thin rectangular head 32(1) and the second thin rectangular head 32(2) (not shown), the dots are formed as the second thin rectangular head 32(2) is disposed to be offset on the back side in the paper width direction to be close to the first thin rectangular head 32(1) (FIG. 3C).

As described above, even when the relative position relationship of the thin rectangular heads 32 arranged in the paper width direction is as designed and when the medium S is transported while skewing, a concentration error occurs at the image part (joint of image) printed at the joint (overlapped area) of the thin rectangular heads 32. Accordingly, concentration unevenness (streak taken along the transport direction) occurs on the printed image, and the image quality of the printed image deteriorates.

In the case of the concentration error (FIG. 3B and FIG. 3C) occurring by the difference of the relative position relationship of the thin rectangular heads 32 arranged in the paper width direction, the method in which the concentration error occurs is regular, and thus it is easy to improve the concentration error. For example, when the concentration of the joint of the image becomes low on the basis of a correction value set for each area (column area) on the medium in which the raster line is printed (to be described later), the dot size printed at the joint of the image is increased or the number of dots is increased. In such a manner, it is possible to correct the concentration of the joint of the image to be high. However, since the method in which the concentration error occurs by the skewing transport of the medium S is not regular, there is a limit in correction of the concentration error based on the correction value.

Disposition of Thin Rectangular Heads 32

Disposition of Comparative Example

Figure 5A:
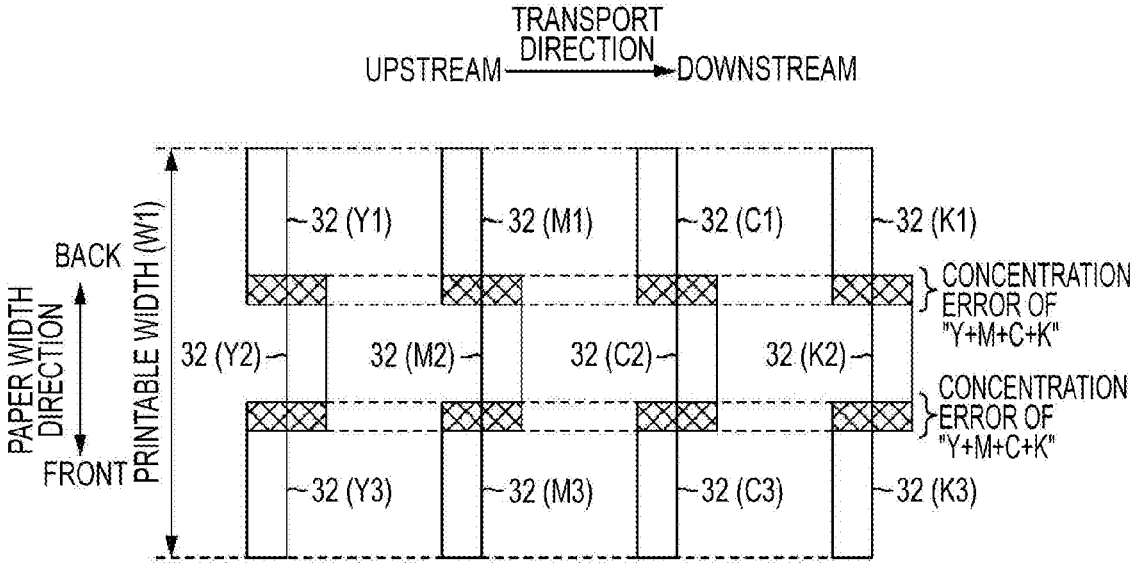
FIG. 5A and FIG. 5B are diagrams illustrating comparative examples of disposition of the thin rectangular heads.
Figure 5B:
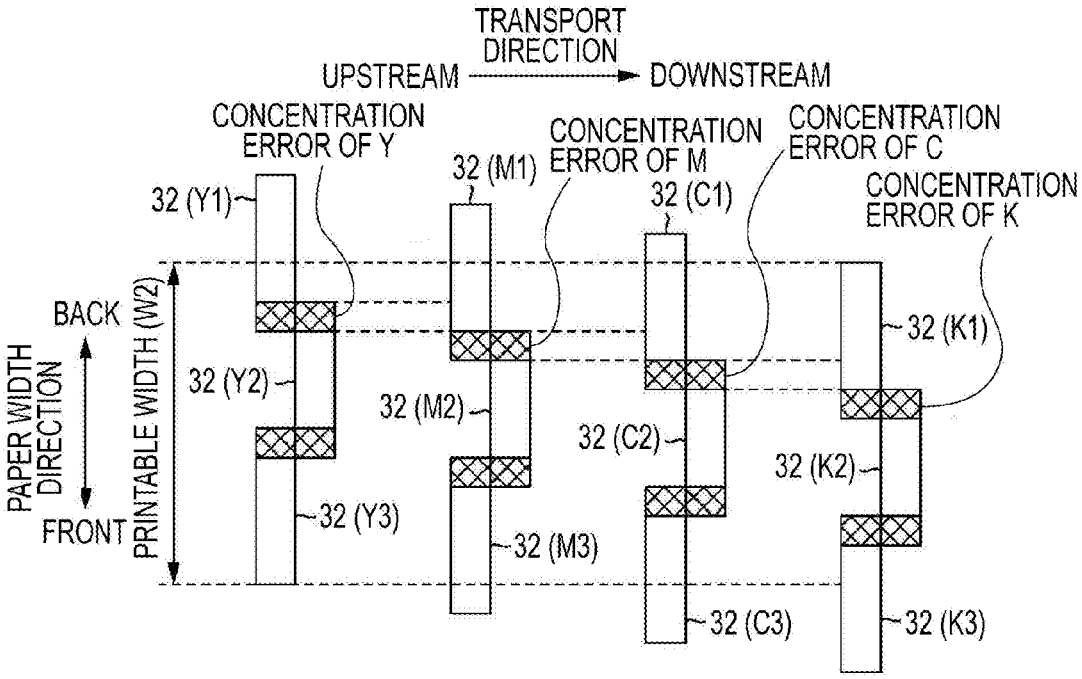

FIG. 5A and FIG. 5B are diagrams illustrating a comparative example of disposition of the thin rectangular heads 32. The printer 1 has a head group 31 for each UV ink (YMCK) of four colors, and the thin rectangular heads 32 are arranged in the paper width direction while the end portions thereof are overlapped in the head groups 31. In the drawings, for brief description, the number of thin rectangular heads 32 is three per color, and the joint (overlapped area) of the thin rectangular heads 32 is represented by crosshatch.

In the comparative example shown in FIG. 5A, as for all the head groups 31 of the UV inks (YMCK) of four colors, the positions in the paper width direction of the joints (overlapped areas) of the thin rectangular heads 32 arranged in the paper width direction are the same. Specifically, the position in the paper width direction of the joint of the first thin rectangular head 32(Y1) and the second thin rectangular head 32(Y2) of yellow, the position in the paper width direction of the joint of the first thin rectangular head 32(M1) and the second thin rectangular head 32(M2) of magenta, the position in the paper width direction of the joint of the first thin rectangular head 32(C1) and the second thin rectangular head 32(C2) of cyan, and the position in the paper width direction of the joint of the first thin rectangular head 32(K1) and the second thin rectangular head 32(K2) of black are the same.

It is assumed that the concentration error occurs at the image part printed at the joint of the thin rectangular heads 32 in all the head groups 31 of four colors (YMCK) by the difference in the relative position relationship of the thin rectangular heads 32 or the skewing transport of the medium. In the comparative example shown in FIG. 5A in which the positions of the joints of the thin rectangular heads 32 of four colors (YMCK) are the same, the image part printed at the joint of the thin rectangular heads 32 of colors, that is, the image parts at which the concentration error occurs are printed to overlap.

Accordingly, lightness or darkness of the image part printed at the joint of the thin rectangular heads 32 is encouraged, or it is difficult to express the image part printed at the joint of the thin rectangular heads 32 to be a desired color. For example, it is assumed that a concentration error of "+5%" occurs at the image part (joint of image) printed at the joint of the thin rectangular heads 32 of four colors (YMCK). Accordingly, when the images of four colors (YMCK) are printed to overlap, the concentration error of the joint of the images is about four times of "+5%". When the image of three colors (YMC) are printed to overlap, the concentration error of the joint of the images is about three times of "+5%". When the image of two colors (Y and M, Y and C, and M and C) are printed to overlap, the concentration error of the joint of the images is about twice of "+5%". For this reason, the part at which the joints of the images with a plurality of colors are printed to overlap is easily recognized as a streak taken along the transport direction on the printed image, and the image quality of the printed image further deteriorates.

That is, in spite of the fact that the concentration error easily occurs at the image part (joint of image) printed at the joint of the thin rectangular heads 32, as shown in the comparative example of FIG. 5A, when the positions in the paper width direction of the joint of the thin rectangular heads 32 are the same for all the head groups 31 of four colors (YMCK), the joints of the images on which the concentration error occurs are printed to overlap, and the image quality of the printed image further deteriorates.

Meanwhile, in the comparative example shown in FIG. 5B, the position of the joint (overlapped area) of the thin rectangular heads 32 is offset in the paper width direction, for all the head groups 31 of four colors (YMCK).

Specifically, the position of the joint of the first thin rectangular head 32(Y1) and the second thin rectangular head 32(Y2) of yellow is positioned on the rearmost side in the paper width direction, the position of the joint of the first thin rectangular head 32(M1) and the second thin rectangular head 32(M2) of magenta is offset on the front side in the paper width direction from the position of the joint of the yellow thin rectangular heads 32, the position of the joint of the first thin rectangular head 32(C1) and the second thin rectangular head 32(C2) of cyan is offset on the front side in the paper width direction from the position of the joint of the magenta thin rectangular heads 32, and the position of the joint of the first thin rectangular head 32(K1) and the second thin rectangular head 32(K2) of black is positioned on the most front side in the paper width direction.

In this case, in the head groups 31 of the colors (YMCK), even when the concentration error occurs at the image parts printed at the joints of the thin rectangular heads 32, the image parts at which the concentration error occurs are not printed to overlap, and are printed to be offset in the paper width direction. Accordingly, in the comparative example of FIG. 5B, it is possible to prevent the concentration error of the image part printed at the joint of the thin rectangular heads 32 from being encouraged, and it is possible to make the image part printed at the joint of the thin rectangular heads 32 close to a desired color as possible.

However, in the comparative example of FIG. 5B, the yellow thin rectangular head 32 group deviating on the most back side in the paper width direction and the black thin rectangular head 32 group deviating on the most front side in the paper width direction can print the image only in the overlapped area. For example, the nozzles on the back side in the paper width direction of the first thin rectangular head 32(Y1) of yellow cannot be used since the nozzles of the other colors (MCK) are not present in the same position in the paper width direction. Accordingly, a printable width W2 in the comparative example of FIG. 5B becomes even shorter than a printable width W1 in the comparative example of FIG. 5A in which the position of the joint of the thin rectangular heads 32 is not offset.

That is, when the positions of the joints of the thin rectangular heads 32 deviates in the paper width direction for all the head groups 31 of four colors (YMCK) in the same manner as the comparative example of FIG. 5B, it is possible to suppress the concentration error of the image part printed at the joint of the thin rectangular heads 32, but the printable width W2 in the paper width direction becomes short. In other words, in the comparative example of FIG. 5B, it is necessary to increase the number of thin rectangular heads 32 or to increase the length of the nozzle column, in order to obtain a desired printable width.

Disposition of Embodiment

Figure 6A:
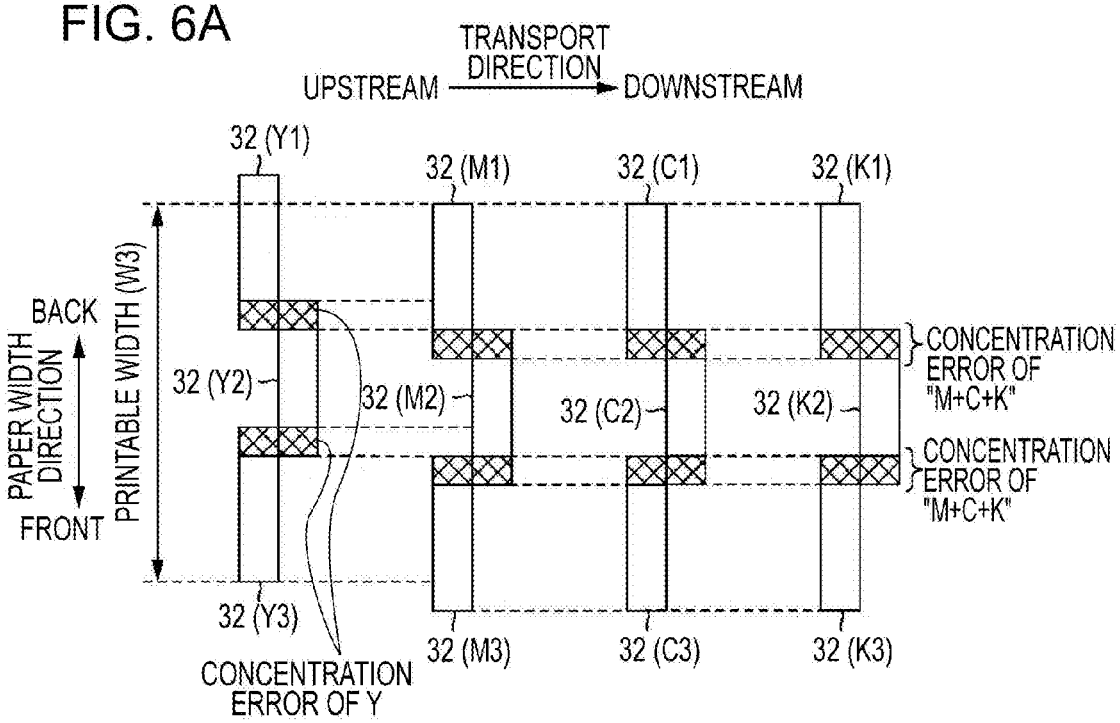
FIG. 6A and FIG. 6B are diagrams illustrating disposition of the thin rectangular heads of the embodiment.
Figure 6B:
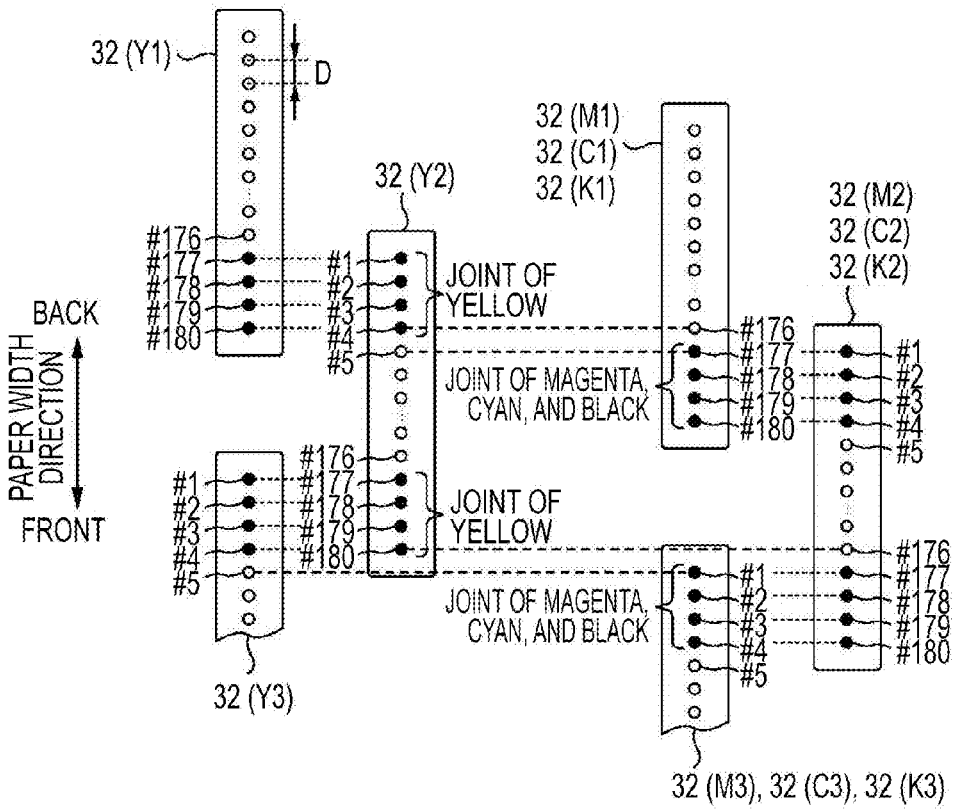

FIG. 6A and FIG. 6B are diagrams illustrating disposition of the thin rectangular heads 32 of the embodiment. In the embodiment, only the position of the joint (overlapped area) of the yellow thin rectangular heads 32 deviates from the position of the joint (overlapped area) of the thin rectangular heads 32 of the other three colors (magenta, cyan, and black) in the paper width direction.

Specifically, "the position in the paper width direction of the joint of the first thin rectangular head 32(Y1) (first yellow nozzle group) and the second thin rectangular head 32(Y2) (second yellow nozzle group) of yellow" deviates on the back side in the paper width direction from "the position in the paper width direction of the joint of the first thin rectangular head 32(M1) (first magenta nozzle group) and the second thin rectangular head 32(M2) (second magenta nozzle group) of magenta", "the position in the paper width direction of the joint of the first thin rectangular head 32(C1) (first cyan nozzle group) and the second thin rectangular head 32(C2) (second cyan nozzle group) of cyan", and "the position in the paper width direction of the joint of the first thin rectangular head 32(K1) (first black nozzle group) and the second thin rectangular head 32(K2) (second black nozzle group) of black".

The position of the joint of the yellow thin rectangular heads 32 may deviate on the front side in the paper width direction from the positions of the joints of the thin rectangular heads 32 of the other three colors (magenta, cyan, and black).

The position in the paper width direction of the joint of the first thin rectangular head 32(M1) and the second thin rectangular head 32(M2) of magenta, the position in the paper width direction of the joint of the first thin rectangular head 32(C1) and the second thin rectangular head 32(C2) of cyan, and the position in the paper width direction of the joint of the first thin rectangular head 32(K1) and the second thin rectangular head 32(K2) of black are the same.

For this reason, in the embodiment, the image part (joint of image) printed at the joint of the yellow thin rectangular heads 32 is not overlapped with the image parts printed at the joints of the thin rectangular heads 32 of magenta, cyan, and black. Accordingly, as compared with the comparative example of FIG. 5A in which the positions of the joints of the thin rectangular heads 32 of all the head groups 31 of four colors (YMCK) are the same, in the embodiment, it is possible to reduce the maximum number of overlaps of the image parts printed at the joints of the thin rectangular heads 32, that is, the maximum number of overlaps of the image parts at which the concentration error occurs, from four to three.

Accordingly, in the embodiment, as compared with the comparative example of FIG. 5A, it is possible to prevent the concentration error of the image part printed at the joint of the thin rectangular heads 32 from being encouraged, and it is possible to make the image part printed at the joint of the thin rectangular heads 32 close to a desired color as possible. Accordingly, the image part (joint of image) printed at the joint of the thin rectangular heads 32 is not easily recognized as a streak taken along the transport direction, and it is possible to suppress the deterioration of the image quality of the printed image.

In the embodiment, only the position of the joint of the yellow thin rectangular heads 32 deviates from the positions of the joints of the thin rectangular heads 32 of the other three colors (MCK), and thus it is possible to increase the printable width in the paper width direction (W3>W2) as compared with the comparative example of FIG. 5B in which the positions of the joints of the thin rectangular heads 32 of four colors (YMCK) deviate from each other.

For example, the positions of the joints of the thin rectangular heads 32 of the other colors deviate in the paper width direction by the length of the overlapped area. Accordingly, as compared with the comparative example of FIG. 5A in which the positions of the joints of the thin rectangular heads 32 do not deviate, in the comparative example of FIG. 5B, the printable width of the length of six overlapped areas becomes short. On the contrary, in the embodiment, as compared with the comparative example of FIG. 5A, the printable width of only the length of two overlapped areas becomes short.

Accordingly, in the embodiment, it is possible to effectively use the nozzles belonging to the thin rectangular heads 32 as compared with the comparative example of FIG. 5B, it is not necessary to increase the number of thin rectangular heads 32 or to increase the length of the nozzle column, in order to obtain a desired printable width.

As described above, in the embodiment, only the position of the joint of the yellow thin rectangular head 32 deviates from the positions of the joints of the thin rectangular heads 32 of the other three colors (MCK), and thus it is possible to expand the printable width in the paper width direction while suppressing the deterioration of the image quality of the printed image.

Possibility that the yellow, magenta, and cyan inks among the UV inks (YMCK) of four colors are printed to overlap with each other is high, but possibility that the black ink is not printed to overlap with the other color inks and is printed alone is high. For this reason, as described in the embodiment, it is preferable that the position of the joint of the thin rectangular heads 32 of yellow that is the color except the black ink among the UV inks (YMCK) of four colors deviate from the positions of the joints of the thin rectangular heads 32 of the other three colors.

Accordingly, possibility that the image part printed at the joint of the yellow thin rectangular heads 32 is printed alone and the image part printed at the joint of the black thin rectangular heads 32 is printed alone is high, and thus the image parts printed at the joints of the thin rectangular heads 32 of magenta and cyan are overlapped.

That is, the position of the joint of the yellow thin rectangular heads 32 except black deviates from the positions of the joints of the thin rectangular heads 32 of the other three colors, and thus it is possible to further reduce the number (maximum number) of overlaps of the image parts printed at the joints of the thin rectangular heads 32, that is, the number (maximum number) of overlaps of the image parts at which the concentration error occurs. In other words, it is possible to lower possibility that the image parts printed at the joints of the thin rectangular heads 32 are overlapped.

The positions of the joints of the thin rectangular heads 32 do not deviate (that is, in the disposition of the thin rectangular heads 32 of FIG. 5A), and the UV inks (YMC) of three colors except black were variously combined to actually print an image. As a result, on the image printed by only the yellow ink, it was difficult to recognize the joint of the image, but on the image printed by overlapping the yellow ink and the other color inks (MC) are printed to overlap, it was easy to recognize the joint of the image. Particularly, it was easy to recognize the joint of the image on a green image printed by overlapping the yellow ink and the cyan ink.

Although the reason is not clear, it is thought that the reason is because the brightness value of the yellow ink is higher than the brightness value of the magenta ink or the cyan ink, and thus the yellow ink has a bad influence when it is printed to overlap with the other color inks or human eyes are relatively sensitive for green. For example, when the correction value is calculated for each column area (each area on medium in which raster line is printed) on the basis of the actually printed test pattern (to be described later), it is more difficult to recognize the concentration error of the yellow test pattern than the test patterns of the other colors, and thus precision of the correction value of yellow tends to be inferior to the correction values of the other colors. For this reason, it is thought that the yellow image printed on the basis of the correction value with low precision and the images of the other colors are overlapped and thus it is easy to recognize the joint of the image.

As described in the embodiment, it is preferable that the position of the joint of the yellow thin rectangular heads 32 among three colors (YMC) except black deviate in the paper width direction from the positions of the joints of the thin rectangular heads 32 of the other three colors (MCK).

In such a manner, it is possible to prevent the image part printed at the joint of the yellow thin rectangular heads 32 from being overlapped with the image part printed at the joints of the thin rectangular heads 32 of the other three colors (MCK). As a result, it is possible to make the image part of the joint of the thin rectangular heads 32 more invisible, and it is possible to suppress the deterioration of the image quality of the printed image. Particularly, it is possible to perform the printing so as not to overlap the image parts printed at the joints of the thin rectangular heads 32 of yellow and cyan in the green image in which the image part printed at the joint of the thin rectangular heads 32.

Summarizing the above, in the embodiment, when the UV inks (YMCK) of four colors ejected by the printer 1 are overlapped with the other color ink, only the position of the joint of the yellow thin rectangular heads 32 in which the image part printed at the joint of the thin rectangular heads 32 is easily visible deviates from the positions of the joints of the thin rectangular heads 32 of the other three colors (MCK), and thus it is possible to expand the printable width in the paper width direction while suppressing the deterioration of the image quality of the printed image.

The UV ink (light curing ink) has a high viscosity, and thus does not easily spread and wet on the medium, and easily becomes round granular. For this reason, when an error occurs in the amount of ejected ink and the condition of irradiation of ultraviolet rays, filling of the medium may deteriorate. For this reason, in the printer 1 using the UV ink, for example, as shown in FIG. 3B, when the thin rectangular heads 32 arranged in the paper width direction are separately disposed, the filling of the medium by the UV ink may further deteriorate. Therefore, in the printer 1 (that is, printer in which ink ejected from nozzles is light curing ink cured by irradiation of light) using the UV ink, as described in the embodiment, it is more effective that the position of the joint of the yellow thin rectangular heads 32 deviates from the positions of the joints of the thin rectangular heads 32 of the other colors.

In the embodiment, the thin rectangular heads 32 (nozzle column) are arranged in the paper width direction while overlapping the end portions. For this reason, for example, as shown in FIG. 3B, even when two thin rectangular heads 32 arranged in the paper width direction are separately disposed, dots are formed by one thin rectangular head 32 (in FIG. 3B, first thin rectangular head 32(1)) of two thin rectangular heads 32. Therefore, in the embodiment, as compared with the case where the end portions of the thin rectangular heads 32 are not overlapped, it is possible to make the image part printed at the joint of the thin rectangular heads 32 more invisible, and it is possible to further suppress the deterioration of the image quality of the printed image.

In the embodiment, the position of the joint (overlapped area) of the yellow thin rectangular heads 32 is adjacent to the positions of the joints (overlapped areas) of the thin rectangular heads 32 of magenta, cyan, and black. That is, the position of the joint of the yellow thin rectangular heads 32 deviates in the paper width direction by the length of the overlapped area from the positions of the joints of the thin rectangular heads 32 of the other three colors (MCK).

Specifically, as shown in FIG. 6B, the position deviating on the front side in the paper width direction by the nozzle distance D from the positions of the joint of the first thin rectangular head 32(Y1) and the second thin rectangular head 32(Y2) of yellow is the positions of the joints of the first thin rectangular head 32(1) and the second thin rectangular head 32(2) of magenta, cyan, and black. That is, the position of the nozzle #5 of the second thin rectangular head 32(Y2) of yellow is the positions of the nozzles #177 of the first thin rectangular heads 32(1) of magenta, cyan, and black.

In such a manner, it is possible to shorten the amount of deviation of the yellow shot head 32 group and the thin rectangular head 32 groups of the other three colors (MCK) as possible, that is, it is possible to make the area where the yellow thin rectangular head 32 group is overlapped with the thin rectangular head 32 groups of the other three colors as long as possible, and thus it is possible to expand a printable width W3 in the paper width direction as possible.

Correction Value H of Concentration Error

The printer 1 of the embodiment stores a correction value H calculated for each "column area" that is an area on the medium forming the raster line (dot column taken along transport direction) by the test pattern printed on the basis of the instruction gradation value representing a predetermined concentration in the memory 13 (corresponding to storage unit) for each color (YMCK) of ink, and prints an image on the medium on the basis of the gradation value obtained by correcting the gradation value (image data) representing the concentration of the printed image by the correction value H.

In such a manner, it is possible to reduce the concentration error of the image part (joint of image) printed at the joint of the thin rectangular heads 32, and it is possible to further suppress the deterioration of the image quality of the printed image.

It is not limited to the image part printed at the joint of the thin rectangular heads 32, and the concentration unevenness occurs on the printed image even by a problem of process precision of nozzles (variation of amount of ejected ink or ink landing position). That is, the concentration error may occur except the image part printed at the joint of the thin rectangular heads 32. Accordingly, for each column area, it is possible to correct the concentration error (concentration unevenness) over the whole of the printed image by the correction value H for each color (YMCK) of ink.

However, as described above, the concentration error of the joint of the image occurring by the difference of the relative position relationship of the thin rectangular heads 32 is regular, and thus can be corrected by the correction value H. However, the concentration error of the joint of the image occurring by the skewing transport of the medium is not regular, and thus there is a limit to correct the concentration error by the correction value H. However, in the printer 1 of the embodiment, the position of the joint of the yellow thin rectangular head 32 deviates from the positions of the joints of the thin rectangular heads 32 of the other three colors, and thus it is possible to prevent the concentration error of the joint of the image occurring by the skewing transport of the medium from being encouraged.

As described above, the concentration error of the yellow test pattern is not easily recognized as compared with the other color test pattern, and precision of the correction value H of yellow tends to be lower than the correction values H of the other colors. However, in the printer 1 of the embodiment, the position of the joint of the yellow thin rectangular heads 32 deviates from the positions of the joints of the thin rectangular heads 32 of the other three colors, and thus it is possible to make the joint of the image invisible even in the case of the image using the yellow ink.

Method of Calculating Correction Value H

Hereinafter, a method of calculating the correction value H of the concentration error for each color (YMCK) of ink will be described. It is preferable that the correction value H be calculated for each printer 1 in the production process or at the time of maintenance of the printer 1. Herein, the correction value H is calculated according to a correction value calculating program installed in a computer connected to the printer 1 at the time of calculating the correction value H.

Figure 7:
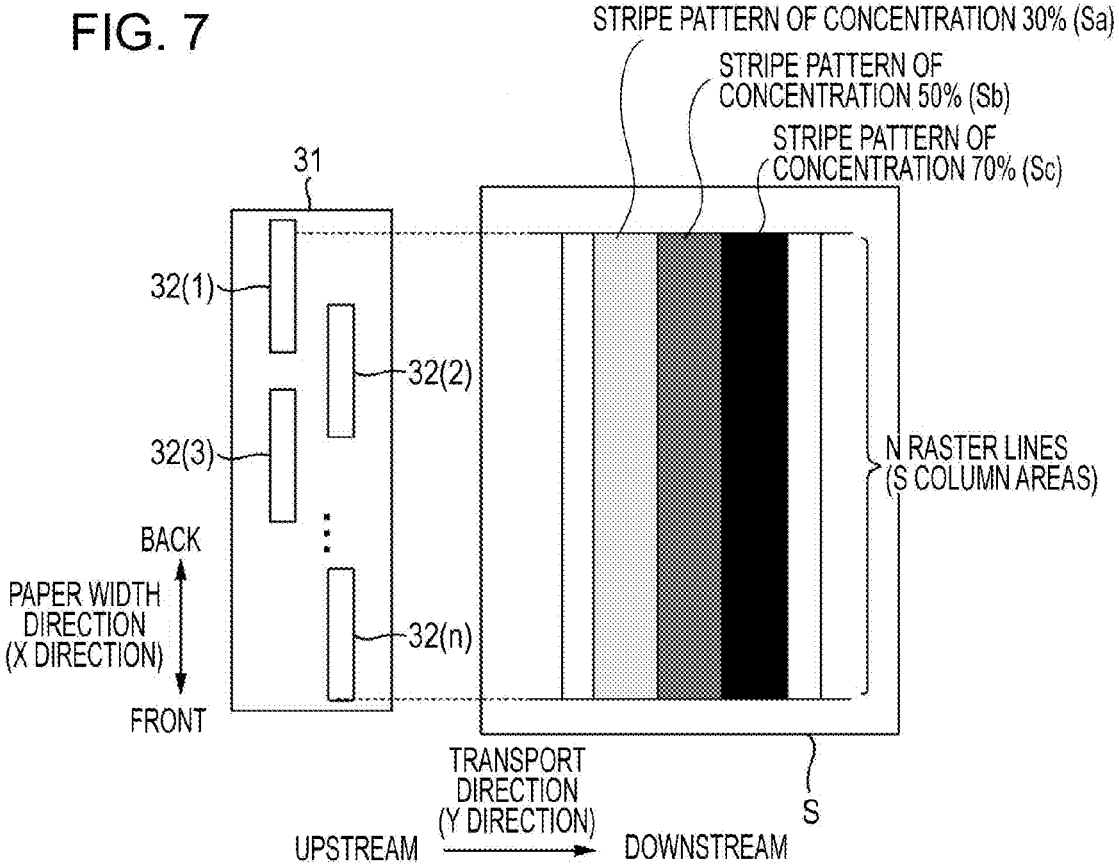
FIG. 7 is a diagram illustrating a test pattern of a color.

FIG. 7 is a diagram illustrating a test pattern of any color. First, the correction value calculating program causes the printer 1 to print a test pattern for each of four color UV inks (YMCK).

The test pattern is formed of stripe-shaped patterns of three kinds of concentrations, and each of the stripe-shaped patterns of three kinds of concentrations is formed from the image data of a constant gradation value. The image data is formed of 2-dimensionally arranged pixels, and the concentrations indicated by the pixels are represented by multi-stage gradation values (0 to 255). Herein, the concentration of the pixel gets lower as the gradation value gets smaller, and the concentration of the pixel gets higher as the gradation value gets larger.

The gradation value to form the stripe-shaped pattern is called an instruction gradation value, the instruction gradation value of the stripe-shaped pattern of concentration of 30% is represented by Sa(76), the instruction gradation value of the stripe-shaped pattern of concentration of 50% is represented by Sb(128), and the instruction gradation value of the stripe-shaped pattern of concentration of 70% is represented by Sc(179).

The printer 1 of the embodiment ejects the ink from the nozzles while transporting the medium S in the transport direction with respect to the head groups 31, to print the image (test patter). Accordingly, the test pattern becomes an image in which the raster lines printed by the nozzles belonging to the printable area are arranged in the paper width direction. For example, when the number of nozzles belonging to the printable area is N, the test pattern is formed of N raster lines arranged in the paper width direction. In other words, the test pattern is formed of N column areas. In N column areas constituting the test pattern, small number (1 to N) are attached in order from the column area on the back side in the paper width direction.

Figure 8:
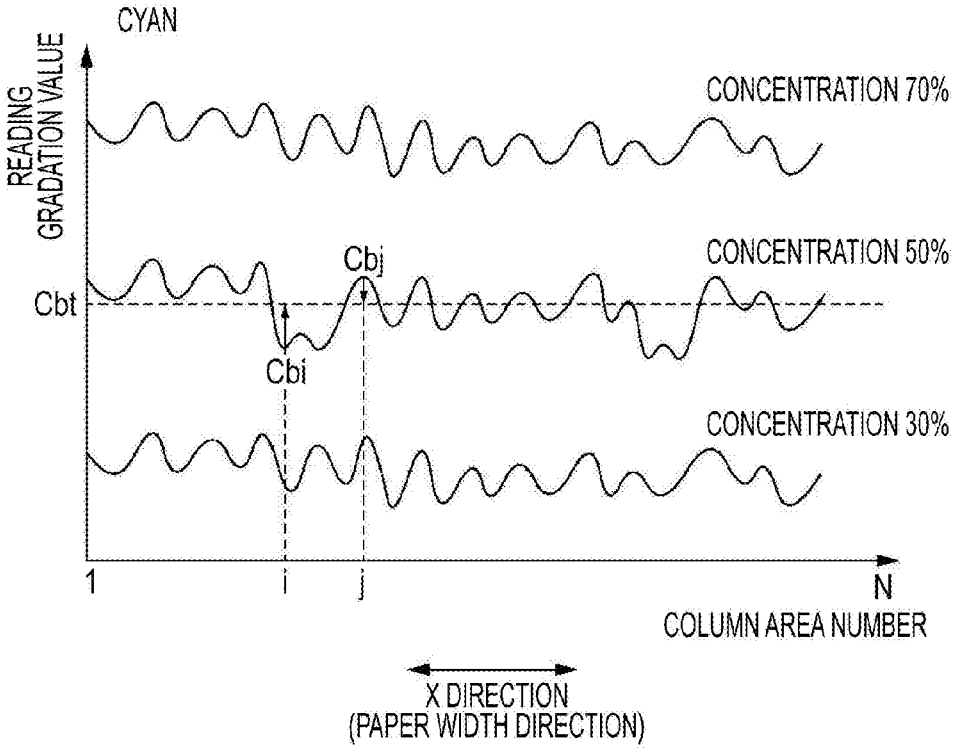
FIG. 8 is a diagram illustrating a result of reading the test pattern by a scanner.

FIG. 8 is a diagram illustrating a reading result of the cyan test pattern by a scanner. The horizontal axis represents the column area numbers (1 to N), and the vertical axis represents the reading gradation value (concentration) of the column areas. Hereinafter, the cyan reading result will be described by way of example.

After the printer 1 prints the test pattern, the correction value calculating program acquires the result (reading data) obtained by reading the test pattern by the scanner. Herein, on the reading data and on the image data, a direction corresponding to the paper width direction of the medium is an X direction, and a direction corresponding to the transport direction of the medium is a Y direction. On the data, columns of pixels arranged in the Y direction (transport direction of medium) are called "pixel columns".

Then, the correction value calculating program associates, one to one, the "pixel columns" on the reading data of the test pattern with the "column areas" on the medium on which the test pattern is printed. The correction value calculating program calculates the reading gradation value (concentration) of each column area, for each stripe-shaped pattern (three kinds of concentrations). Specifically, the correction value calculating program calculates an average value of the reading gradation values indicated by the pixels corresponding to the stripe-shaped pattern of any instruction gradation value (for example, Sb) among the pixels belonging to the pixel column corresponding to any column area i, and the calculated average value is the reading gradation value (concentration) of the instruction gradation value (for example, Sb) of any column area i.

As a result, it is possible to obtain the reading result shown in FIG. 8. Even though each stripe-shaped pattern is uniformly printed by each instruction gradation value (Sa, Sb, and Sc), variation occurs in the reading gradation value (concentration) for each column area. For example, in the graph shown in FIG. 8, the reading gradation value Cbi of the i column area is relatively smaller than the reading gradation value of the other column area and is faintly recognized, and the reading gradation value Cbj of the j column area is relatively higher than the reading gradation value of the other column area and is thickly recognized. The variation of the reading gradation values of the column areas 1 to N is the concentration error (concentration unevenness) occurring on the printed image.

Accordingly, the reading gradation values of the column areas 1 to N are close to a constant value, and thus it is possible to improve the concentration error of the image part printed at the joint of the thin rectangular heads 32 or the concentration error occurring by the problem in process precision of nozzles.

For this reason, for example, the average value Cbt of the reading gradation values of the whole column areas 1 to N in the same instruction gradation value (for example, Sb) is set to a "target value Cbt". The correction value H for correcting the image data (gradation value) corresponding to the column areas 1 to N is calculated such that the reading gradation values of the column areas 1 to N when the printing is performed by the instruction gradation value Sb is close to the target value Cbt.

Specifically, the gradation value indicated by the image data corresponding to the column area i with the reading gradation value smaller than the target value Cbt is corrected to a gradation value (higher gradation value) larger than the instruction gradation value Sb. Meanwhile, the gradation value indicated by the image data corresponding to the column area j with the reading gradation value larger than the target value Cbt is corrected to a gradation value (lower gradation value) smaller than the instruction gradation value Sb. As described above, the gradation value corrected from the instruction gradation value Sb such that the reading gradation values of the column areas 1 to N are the target value Cbt is called "target instruction gradation value Sbt".

Figure 9A:
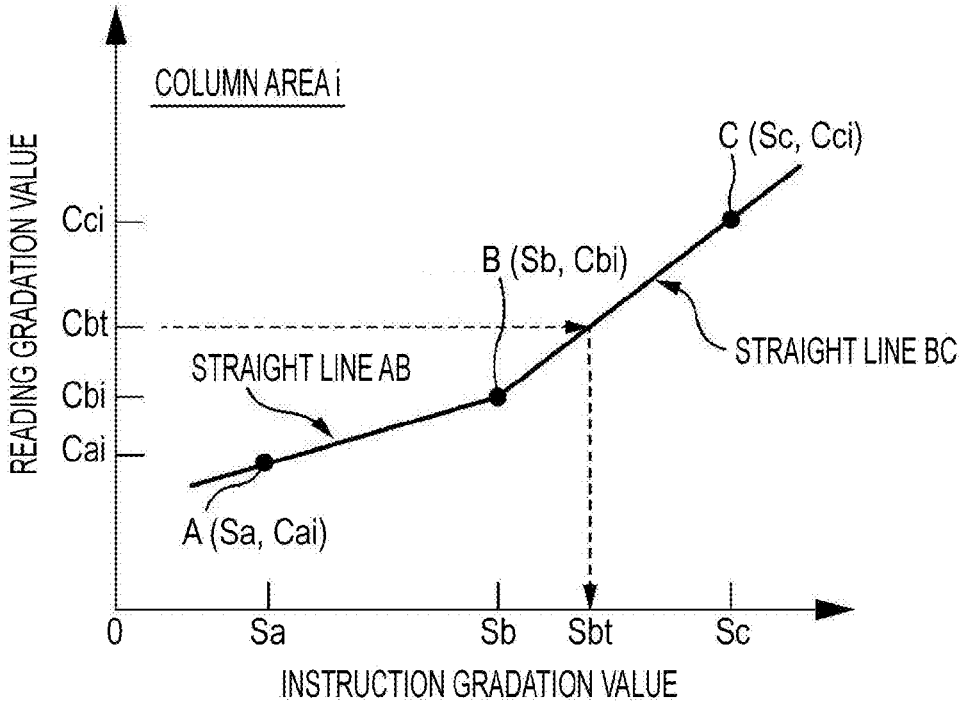
FIG. 9A and FIG. 9B are diagrams illustrating the calculation of a target instruction gradation value.
Figure 9B:
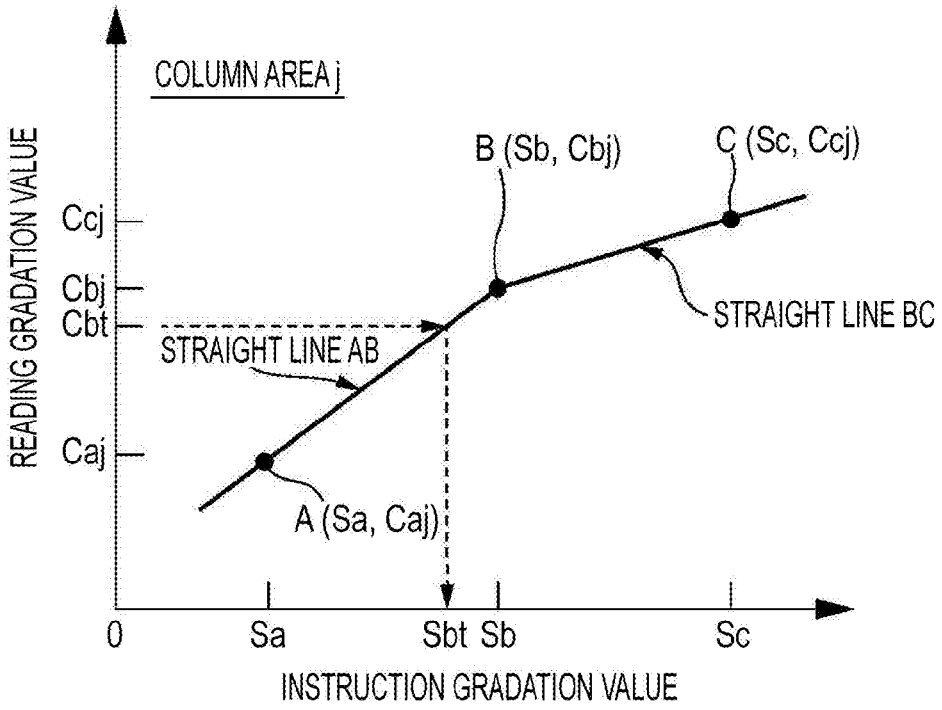

FIG. 9A is a diagram illustrating a form of calculating the target instruction gradation value Sbt of the column area i with the reading gradation value Cbi smaller than the target value Cbt, and FIG. 9B is a diagram illustrating a form of calculating the target instruction gradation value Sbt of the column area j with the reading gradation value Cbj larger than the target value Cbt. The horizontal axis represents the instruction gradation value, and the vertical axis represents the reading gradation value of the test pattern. In the graphs, the results of the reading gradation values (Cai, Cbi, and Cci) for the instruction gradation values (Sa, Sb, and Sc) are plotted.

As shown in FIG. 9A, the target instruction gradation value Sbt in which the column area i is represented in the target value Cbt with respect to the instruction gradation value Sb is calculated by the following formula (linear interpolation based on straight line BC).

$$Sbt=Sb+\{(Sc-Sb)\times(Cbt-Cbi)/(Cci-Cbi)\}$$

Similarly, as shown in FIG. 9B, the target instruction gradation value Sbt in which the column area j is represented in the target value Cbt with respect to the instruction gradation value Sb is calculated by the following formula (linear interpolation based on straight line AB).

$$Sbt=Sa+\{(Sb-Sa)\times(Cbt-Caj)/(Cbj-Caj)\}$$

In such a manner, the correction value calculating program calculates the target instruction gradation value Sbt for the instruction gradation value Sb for each of the column areas 1 to N, and then calculates the cyan correction value Hb for the instruction gradation value Sb of each of the column areas 1 to N.

$$Hb=(Sbt-Sb)/Sb$$

The correction value calculating program calculates the correction value H of each of the column areas 1 to N with respect to the other instruction gradation values (Sa and Sc) and the other colors (YMK). That is, the correction value calculating program calculates the correction value H for each of the instruction gradation values (Sa, Sb, and Sc) for each of the ink colors (YMCK) for each of the column areas (1 to N).

Figure 10:
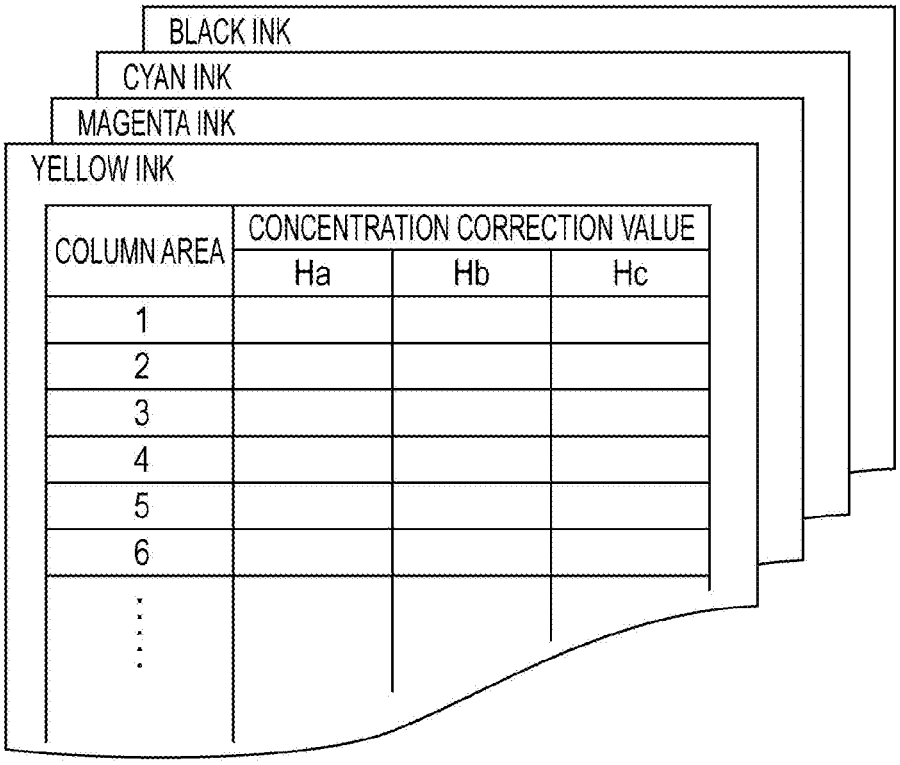
FIG. 10 is a diagram illustrating a correction value table.

FIG. 10 is a diagram illustrating a correction value table. The correction value calculating program summarizes the calculated correction values H for each of the ink colors (YMCK) in the correction value table. In the correction value table, three instruction gradation values (Sa, Sb, and Sc) are associated with the correction values (Ha, Hb, and Hc) for each of the column areas (1 to N). The correction value calculating program stores the correction value table in the memory 13 of the printer 1. Thereafter, the printer 1 is shipped to the user.

Concentration Correcting Process by Correction Value H

The user installs a printer driver in the computer connected to the printer 1 at the start of using the printer 1. The printer driver acquires the correction value table (FIG. 10) stored in the memory 13 of the printer 1.

When the printer driver receives image data for printing of the printer 1 from various application programs, the printer driver creates printing data for performing the printing of the printer 1. First, the printer driver converts a resolution of the received image data into a printing resolution at the time of printing of the printer 1 by a resolution conversion process. Then, the printer driver converts the image data that is RGB data into YMCK data corresponding to the color of the inks provide in the printer 1 by a color conversion process.

Thereafter, the printer driver corrects the gradation values (0 to 255) indicated by the pixels constituting the image data on the basis of the correction value H for each column area, for each color, and for each instruction gradation value, with reference to the correction value table.

When a gradation value S_in before correction indicated by the pixels is the same as one of the instruction gradation values Sa, Sb, and Sc, it is possible to apply the correction values Ha, Hb, and Hc stored in the correction value table, as they are. For example, when the gradation value S_in before correction is Sc, a gradation value S_out after correction is acquired by the following formula.

$$S_out=S_in\times(1+Hc)$$

Figure 11:
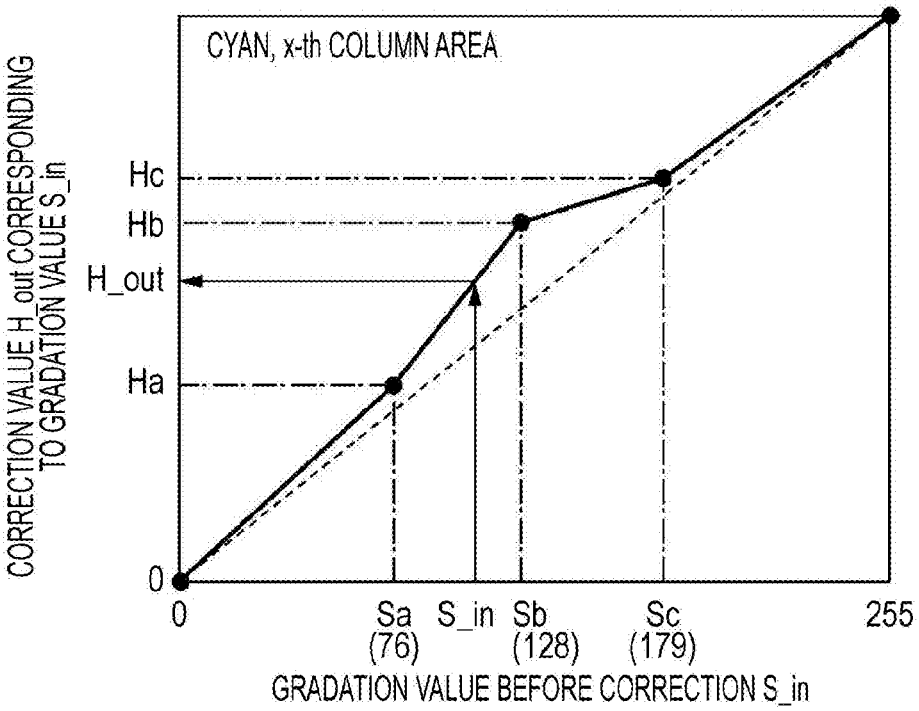
FIG. 11 is a diagram illustrating the calculation of a correction value corresponding to a gradation value before correction.

FIG. 11 is a diagram illustrating a form of calculating the correction value H_out corresponding to the gradation value S_in before correction with respect to the x-th column area of cyan. The horizontal axis represents the gradation value S_in before correction, and the vertical axis represents the correction value H_out corresponding to the gradation value S_in before correction. When the gradation value S_in before correction is different from the instruction gradation values (Sa, Sb, and Sc), first, the printer driver calculates the correction value H_out corresponding to the gradation value S_in before correction.

For example, as shown in FIG. 11, the gradation value S_in before correction is between the instruction gradation values Sa and Sb, the printer driver calculates the correction value H_out corresponding to the gradation value S_in before correction, by the linear interpolation of the correction value Ha corresponding to the instruction gradation value Sa and the correction value Hb corresponding to the instruction gradation value Sb. Then, the gradation value S_in is corrected by the calculated correction value H_out.

$$H_out=Ha+\{(Hb-Ha)\times(S_in-Sa)/(Sb-Sa)\}$$

$$S_out=S_in\times(1+H_out)$$

When the gradation value S_in before correction is smaller than the instruction gradation value Sa, the correction value H_out is calculated by the linear interpolation of the minimum gradation value 0 and the instruction gradation value Sa. When the gradation value S_in before correction is larger than the instruction gradation value Sc, the correction value H_out is calculated by the linear interpolation of the instruction gradation value Sc and the maximum gradation value 255.

In such a manner, the gradation value S_in indicated by the pixels corresponding to the column area in which the concentration is faintly recognized is corrected to the large gradation value S_out, and the gradation value S_in indicated by the pixels corresponding to the column area in which the concentration is thickly recognized is corrected to the small gradation value S_out.

Thereafter, the printer driver converts the image data (gradation value S_out) corrected on the basis of the correction value H from data of a large number of gradations (0 to 255) into data of a smaller number of gradations which can be expressed by the printer 1, by a halftone process. Lastly, the printer driver sorts the image data in matrix in order of transmission to the printer 1 by a rasterization process, and transmits the image data to the printer 1.

The printer 1 performs printing on the basis of the received printing data. In such a manner, it is possible to improve the concentration error of the image printed by the printer 1. The process of the printer driver may be performed by the controller 10 provided in the printer 1.

Modified Example

Figure 12A:
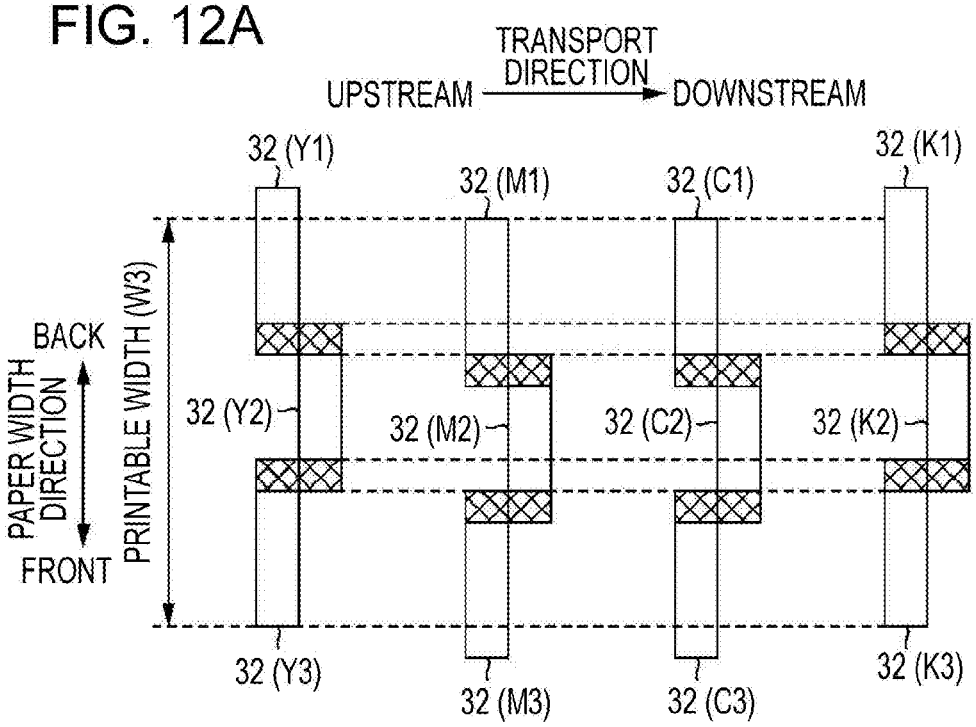
FIG. 12A and FIG. 12B are diagrams illustrating modified examples of the disposition of the thin rectangular heads.
Figure 12B:
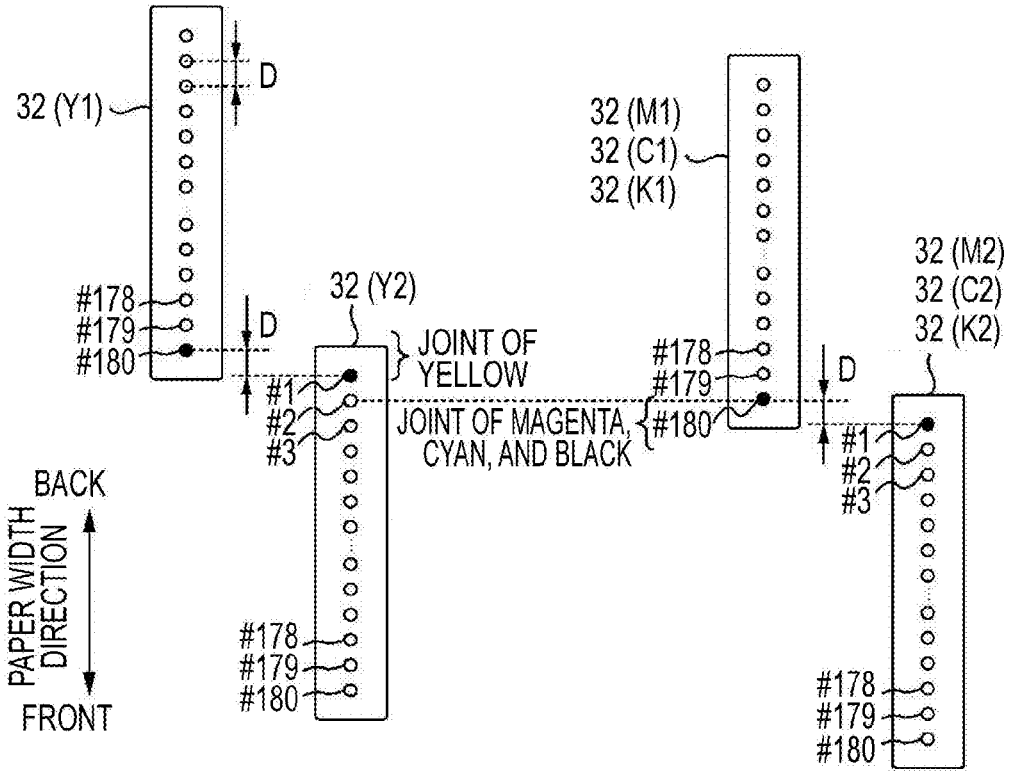

FIG. 12A and FIG. 12B are diagrams illustrating a modified example of disposition of the thin rectangular heads 32. In the embodiment (FIG. 6A and FIG. 6B) described above, the position of the joint of the yellow thin rectangular heads 32 deviates from the positions of the joints of the thin rectangular heads 32 of magenta, cyan, and black, the invention is not limited thereto. For example, as shown in FIG. 12A, the position of the joint of the yellow thin rectangular head 32 deviates from the positions of the joints of the thin rectangular heads 32 of magenta and cyan, but the position of the joint of the yellow thin rectangular heads 32 may be the same as the position of the joint of the black thin rectangular heads 32.

Even in this case, it is possible to prevent the image part printed at the joint of the yellow thin rectangular heads 32 from being overlapped with the image parts printed at the joints of the thin rectangular heads 32 of magenta and cyan. Possibility that the yellow image and the black image are printed to overlap is low. Accordingly, it is possible to make the image part printed at the joint of the thin rectangular heads 32 invisible.

In the modified example, since the position of the joint of the yellow thin rectangular heads 32 is the same as the position of the joint of the black thin rectangular heads 32, the printable width W3 in the paper width direction is as described in the embodiment (FIG. 6A and FIG. 6B) described above. In the modified example, it is possible to disperse the positions of the joints of the thin rectangular heads 32 of four colors (YMCK), by each two colors, in the paper width direction, and thus the maximum number of overlaps of the image parts printed at the joints of the thin rectangular heads 32 can be two.

In the embodiment, the end portions of the thin rectangular heads 32 (nozzle columns) are overlapped, but the invention is not limited thereto, and the end portions of the thin rectangular heads 32 (nozzle columns) may not be overlapped. For example, as shown in FIG. 12B, the thin rectangular heads 32 may be disposed such that a distance in the paper width direction between the end portion nozzle #180 on the most front side of the thin rectangular head (for example, 32(Y1)) on the back side in the paper width direction and the end portion nozzle #1 on the most back side of the thin rectangular head (for example, 32(Y2)) on the back side in the paper width direction out of two thin rectangular heads (for example, 32(Y1) and 32(Y2)) arranged in the paper width direction is the nozzle distance D.

In this case, the end portion nozzle #180 on the most front side of the thin rectangular head (for example, 32(Y1)) on the back side in the paper width direction and the end portion nozzle #1 on the most back side of the thin rectangular head (for example, 32(Y2)) on the back side in the paper width direction correspond to the joint of the thin rectangular heads 32, and the concentration error easily occur at the image part printed at the joint. Accordingly, as shown in FIG. 12B, the position of the joint of the yellow thin rectangular heads 32 deviates from the positions of the joints of the thin rectangular heads 32 of magenta, cyan, and black, and thus it is possible to expand the printable width in the paper width direction while suppressing the deterioration of the image quality of the printed image.

In the embodiment described above, as shown in FIG. 6B, the position of the joint of the yellow thin rectangular head 32 is adjacent to the positions of the joints of the thin rectangular heads 32 of the other three colors, but the invention is not limited thereto, and the position of the joint of the yellow thin rectangular heads 32 may be separated from the positions of the joints of the thin rectangular heads 32 of the other three colors. For example, the joints of the first thin rectangular heads 32(1) and the second thin rectangular heads 32(2) of magenta, cyan, and black may be positioned at the center (for example, in the vicinity of nozzle #90) in the paper width direction of the second thin rectangular heads 32(Y2) of yellow.

The printer 1 described above ejects the inks of four colors (YMCK), but the invention is not limited thereto, and may be a printer that ejects the yellow, magenta, and cyan inks of three colors and does not eject the black ink. Even in this case, the positions of the joints of the thin rectangular heads 32 of magenta and cyan deviate from the position of the joint of the yellow thin rectangular heads 32, and the positions of the joints of the thin rectangular heads 32 of magenta and cyan are the same.

Other Embodiments

The embodiments described above mainly describe the printing apparatus, but include disclosure of the printing method and the like. The embodiments described above are provided to facilitate understanding of the invention, but not to limit the scope of the invention to those embodiments. The invention may be modified and improved without deviating from the concept thereof, and it is obvious that the invention includes equivalents thereof.

Printer

In the embodiment described above, the printer 1 which ejects the ink from the head groups 31 (nozzles) when the medium S passes under the fixed head groups 31 is exemplified, but the invention is not limited thereto. For example, the printer 1 may be a printer in which an operation of ejecting ink from a head moving along a movement direction and a transport operation of transporting a medium in a transport direction crossing the movement direction are repeated. For example, the printer 1 may be a printer in which an operation of forming an image while moving a head in a transport direction of a medium and an operation of moving the head in the paper width direction are repeated to form an image, and then a medium part on which the printing has not been performed yet is transported to a printing area.

Ink

In the embodiment described above, the ultraviolet curing ink (UV ink) is exemplified as the ink used in the printer 1, but the invention is not limited thereto. For example, the ink used in the printer 1 may be ink cured by irradiation of visible rays, or may be aqueous ink or organic-solvent-based ink permeating a medium.

What is claimed is:

1. A printing apparatus comprising:

a medium transport member for transporting a medium in a medium transporting direction;

a first nozzle group for a first color in which a plurality of nozzles for ejecting a first color ink are arranged in a width direction of the medium;

a second nozzle group for the first color in which the plurality of nozzles for ejecting the first color ink are arranged in the width direction of the medium and which is disposed to be offset from the first nozzle group for the first color in the transporting direction, wherein seeing in the medium transporting direction, the first nozzle group for the first color and the second nozzle group for the first color have a first overlapping area;

a first nozzle group for a second color in which a plurality of nozzles for ejecting a second color ink are arranged in the width direction of the medium;

a second nozzle group for the second color in which the plurality of nozzles for ejecting the second color ink are arranged in the width direction of the medium and which is disposed to be offset from the first nozzle group for the second color in the transporting direction, wherein seeing in the medium transporting direction, the first nozzle group for the second color and the second nozzle group for the second color have a second overlapping area;

a first nozzle group for a third color in which a plurality of nozzles for ejecting a third color ink are arranged in the width direction of the medium;

a second nozzle group for the third color in which the plurality of nozzles for ejecting the third color ink are arranged in the width direction of the medium and which is disposed to be offset from the first nozzle group for the third color in the transporting direction, wherein seeing in the medium transporting direction, the first nozzle group for the third color and the second nozzle group for the third color have a third overlapping area;

a first nozzle group for a fourth color in which a plurality of nozzles for ejecting a fourth color ink are arranged in the width direction of the medium;

a second nozzle group for the fourth color in which the plurality of nozzles for ejecting the fourth color ink are arranged in the width direction of the medium and which is disposed to be offset from the first nozzle group for the fourth color in the transporting direction, wherein seeing in the medium transporting direction, the first nozzle group for the fourth color and the second nozzle group for the fourth color have a fourth overlapping area, wherein seeing in the medium transporting direction, the first overlapping area is located at a position different from the position of each of the second overlapping area, the third overlapping area and the fourth overlapping area, and wherein the second nozzle group of each color are disposed adjacent to the first nozzle group of the corresponding color in the transport direction.

2. The printing apparatus according to claim 1, wherein the first color is yellow.

3. The printing apparatus according to claim 1, wherein seeing in the medium transporting direction, the first overlapping area, the second overlapping area, the third overlapping area and the fourth overlapping area are located each at a different position.

4. The printing apparatus according to claim 1, wherein seeing in the medium transporting direction, anywhere within a printable width of the medium in the width direction of the medium, a plurality of nozzles for the first color, the second color, the third color and the fourth color are arranged in a predetermined pitch.

5. The printing apparatus according to claim 1, wherein the plurality of nozzles for ejecting the first color ink are arranged at an upstream side compared with positions arranged for the plurality of nozzles for ejecting the second color ink, the third color ink and the fourth color ink.

6. The printing apparatus according to claim 1, wherein the first color ink, the second color ink, the third color ink and the fourth color ink are UV ink.

7. The printing apparatus according to claim 1, further comprising a UV irradiation member is arranged at a downstream side of the plurality of nozzles for ejecting the first color ink and an upstream side of the plurality of nozzles for ejecting the second color ink.

8. The printing apparatus according to claim 1, further comprising a UV irradiation member is arranged at a downstream side of the plurality of nozzles for ejecting the second color ink and an upstream side of the plurality of nozzles for ejecting the third color ink.

9. The printing apparatus according to claim 1, further comprising a UV irradiation member is arranged at a downstream side of the plurality of nozzles for ejecting the third color ink and an upstream side of the plurality of nozzles for ejecting the fourth color ink.

10. The printing apparatus according to claim 1, further comprising a UV irradiation member is arranged at a downstream side of the plurality of nozzles for ejecting the fourth color ink.

11. The printing apparatus according to claim 1, wherein the medium transport member transports the medium in the medium transporting direction at a constant speed while a printing operation is carried out.

* * * * *